US011584629B2

(12) United States Patent
Kim et al.

(10) Patent No.: US 11,584,629 B2
(45) Date of Patent: Feb. 21, 2023

(54) REFRIGERATOR FOR DRINKS

(71) Applicant: LG ELECTRONICS INC., Seoul (KR)

(72) Inventors: Dae Woong Kim, Seoul (KR); Hee Su Yang, Seoul (KR); Min Kyu Oh, Seoul (KR); Su Young Lee, Seoul (KR); Ja Yoen Kim, Seoul (KR); Hwa Yun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 63 days.

(21) Appl. No.: 17/193,663

(22) Filed: Mar. 5, 2021

(65) Prior Publication Data

US 2021/0276852 A1 Sep. 9, 2021

(30) Foreign Application Priority Data

Mar. 6, 2020 (KR) ..... 10-2020-0028204

(51) Int. Cl.

| | |
|---|---|
| ***B67D 1/00*** | (2006.01) |
| ***B67D 1/07*** | (2006.01) |
| ***B67D 1/08*** | (2006.01) |
| ***B67D 1/12*** | (2006.01) |

(52) U.S. Cl.

CPC ..... *B67D 1/0004* (2013.01); *B67D 1/07* (2013.01); *B67D 1/0857* (2013.01); *B67D 1/1277* (2013.01); *B67D 2001/0092* (2013.01); *B67D 2001/0097* (2013.01); *B67D 2001/082* (2013.01)

(58) Field of Classification Search

CPC ..... B67D 1/0004; B67D 1/07; B67D 1/0857; B67D 1/1277

See application file for complete search history.

(56) References Cited

U.S. PATENT DOCUMENTS

| | | | | |
|---|---|---|---|---|
| 11,339,043 | B1 * | 5/2022 | Qin | B67D 1/0885 |
| 2003/0098314 | A1 * | 5/2003 | Phelps | B67D 1/0406 222/1 |
| 2009/0218365 | A1 * | 9/2009 | Taradalsky | B67D 3/0054 222/400.7 |
| 2010/0005811 | A1 * | 1/2010 | Jaffe | B67D 1/0004 222/386 |
| 2011/0042458 | A1 * | 2/2011 | Falci | B67D 1/04 222/399 |

(Continued)

FOREIGN PATENT DOCUMENTS

| | | | |
|---|---|---|---|
| KR | 20-0380906 | Y1 | 4/2005 |
| KR | 10-0526606 | B1 | 11/2005 |
| KR | 10-1482732 | B1 | 1/2015 |

*Primary Examiner* — Jeremy Carroll

(74) *Attorney, Agent, or Firm* — Birch, Stewart, Kolasch & Birch, LLP

(57) ABSTRACT

A refrigerator for drinks is provided. The refrigerator may include a cabinet having a storage compartment therein, and a dispenser nozzle disposed to be at least partially exposed outside the cabinet. A pump connection line being able to increase pressure in a drink container by delivering high-pressure air into the drink container and a tank connection line preventing oxidation of the drink in the drink container by delivering an unreactive gas into the drink container may be disposed in the cabinet. Accordingly, two functions of discharging a drink and preventing oxidation may be individually performed, so consumption of an unreactive gas may be reduced.

19 Claims, 18 Drawing Sheets

(56) References Cited

U.S. PATENT DOCUMENTS

| | | | | |
|---|---|---|---|---|
| 2011/0253746 | A1* | 10/2011 | O'Keefe, Jr. ..... | B67D 1/0005 222/173 |
| 2017/0022040 | A1* | 1/2017 | Koretz ..... | B67D 1/0891 |
| 2017/0334704 | A1* | 11/2017 | Koretz ..... | B67D 1/0809 |
| 2018/0330565 | A1* | 11/2018 | Koretz ..... | B67D 1/0885 |

* cited by examiner

REFRIGERATOR FOR DRINKS

CROSS REFERENCE TO RELATED APPLICATION

The present application claims priority to Korean Patent Application No. 10-2020-0028204, filed on Mar. 6, 2020, the entire content of which is incorporated herein by reference.

BACKGROUND OF THE INVENTION

Field of the Invention

The present disclosure relates to a refrigerator for drinks and, more particularly, to a refrigerator for drinks designed to cool a drink in a bottle.

Description of the Related Art

In general, a refrigerator is a home appliance that can keep food at a low temperature in a storage space that is closed by a door. To this end, a refrigerator is configured to keep stored food in an optimal state by cooling the inside of the storage space using cold air that is generated by exchanging heat with a refrigerant circulating in a refrigeration cycle.

Recently, the function of refrigerators is increasing varied with the tendency of a change of dietary life and an increase in quality of the products, and refrigerators having various structures and convenient equipment to enable users to conveniently use the refrigerator and efficiently use the internal space are coming into the market. In particular, as consumption and preference for alcohols such as wine and champagne increase, refrigerators suitable for keeping alcohols in accordance with the kinds of alcohols and refrigerators for keeping ripe food such as Kimchi, etc. have been developed.

Among refrigerators, the demand for a wine refrigerator that can keep drinks such as wine is recently increasing among people. Such wine refrigerators have been disclosed in Korean Patent No. 10-0526606 and Korean Utility Model Registration No. 20-0380906.

Some of such wine refrigerators keep a wine bottle an in erect state and have a dispenser for dispensing wine from a wine bottle. For example, a technology of keeping a wine bottle in an erect state and discharging wine outside through a discharge pipe has been disclosed in Korean Patent No. 10-1482732. In this case, the internal pressure of a wine bottle is increased to discharge wine, and to this end, an inert gas is injected into the wine bottle from a gas tank.

However, the inert gas in the gas tank is consumed, so there is a defect that the gas tank should be periodically replaced. In particular, the more frequently the wine is discharged, the shorter the replacement period of the gas tank, which increases the maintenance cost for the dispenser.

It may be considered to replace the gas tank with an air pump in order to reduce the maintenance cost, but when air is injected into a drink container by the air pump, the drink is oxidized and the flavor changes.

Further, gas tanks are laid on the front lower portion in the dispensers of the related art, so it is required to separate first the gas tank in order to replace the gas tank and then a gas tank is laid to be installed. Accordingly, there is a defect that it is complicated to replace a gas tank.

Further, a tube for discharging a drink from a drink container (a wine bottle, etc.) is fixed in the dispensers of the related art. Since a drink moves through the tube, the tube should be washed, but the tube is fixed, so it is difficult to wash. For example, in order to wash the tube, a drink container filled with washing water is put into the dispenser and then washing water is discharged so that the tube is washed in this process. Accordingly, there is a defect that it is complicated to wash internal pipes such as the tube.

Documents of Related Art (Patent Document 1) Korean Patent No. 10-0526606;
(Patent Document 2) Korean Utility Model Registration No. 20-0380906;
(Patent Document 3) Korean Patent No. 10-1482732

SUMMARY OF THE INVENTION

The present disclosure has been made in an effort to solve the problems of the related art and an objective the pre present disclosure is to separate and independently operate a unit (air pump) for injecting air to discharge a drink from a drink container and a unit (gas tank) for injecting an unreactive gas to prevent oxidation of a drink.

Another objective of the present disclosure is to install a gas tank for injecting an unreactive gas into a drink container on the top of a refrigerator for drinks.

Another objective of the present disclosure is to install an injection pipe for injecting air or an unreactive gas into a drink container and a discharge pipe for discharging a drink in a drink container in a cover assembly that can be separated from a refrigerator.

According to characteristics of the present disclosure for achieving the objectives described above, the present disclosure may include a cabinet having a storage compartment therein and a dispenser nozzle disposed to be at least partially exposed outside the cabinet. A pump connection line being able to increase pressure in a drink container by delivering high-pressure air into the drink container and a tank connection line preventing oxidation of the drink in the drink container by delivering an unreactive gas into the drink container may be disposed in the cabinet. Accordingly, two functions of discharging a drink and preventing oxidation may be individually performed, so consumption of an unreactive gas may be reduced.

An air pump connected to the pump connection line and providing high-pressure air into the pump connection line and a gas tank connected to the tank connection line and providing an unreactive gas to the tank connection line may be disposed in the cabinet. As the air pump and the gas tank are disposed in the cabinet, both of two function of discharging a drink and preventing oxidation may be included in one refrigerator for drinks.

The gas tank may be received into an erect state through a tank mount hole formed at an upper cover of the cabinet. Accordingly, a user may easily replace the gas tank.

The drink container may be inserted into the storage compartment through an open hole being open upward at an upper cover of the cabinet, a door may be disposed at the cabinet, and the open hole and the tank mount hole for receiving the gas tank may be selectively closed by the door. Accordingly, since both the drink container and the gas tank may be closed, cooling efficiency may be increased the external appearance may be made aesthetic.

A supply pipe may be disposed in the cabinet, thereby selectively connecting the air pump and the gas tank to the inside of the drink container. Since the air pump and the gas tank separated from each other may be connected to one supply pipe, the structure of the pipes in the refrigerator for drinks may be simplified.

The supply pipe may include a pump connection line coupled to the air pump, a tank connection line coupled to the gas tank, and a first valve connected with the pump connection line and the tank connection line. A main supply line may be coupled to the first valve and connected to any one of the pump connection line and the tank connection line by the first valve.

An injection pipe for injecting air or an unreactive gas into the drink container may be connected to the main supply line. Accordingly, there may be no need for a specific pipe for injecting high-pressure air or unreactive gas into the drink container.

Several storage compartments may be formed in the cabinet and several dispenser nozzles may be connected to the storage compartments, respectively. Several diverging lines connected to drink containers received in the storage compartments, respectively, may be connected to the main supply line through a second valve. Accordingly, even if several drink containers are received, it may be possible to inject high-pressure air or an unreactive gas into the drink containers.

An inlet of the drink container may be selectively coupled to a cover assembly, and the cover assembly may close the storage compartment by blocking an inlet of the storage compartment when the cover assembly is locked and fixed to an upper cover of the cabinet. That is, the cover assembly may function as a handle and an internal door.

An inlet of the drink container may be selectively coupled to a cover assembly and the cover assembly may include an injection pipe. When the cover assembly is seated on an upper cover of the cabinet while fixing the inlet of the drink container, the injection pipe may be connected to a supply pipe and may be supplied with air or an unreactive gas.

The cover assembly may include: an injection pipe that is connected to the supply pipe when the cover assembly is seated on an upper cover of the cabinet while fixing the inlet of the drink container; and a discharge pipe that is connected to the dispenser nozzle to discharge the drink in the drink container to the dispenser nozzle when the cover assembly is seated on an upper cover of the cabinet while fixing the inlet of the drink container. Accordingly, when the cover assembly functioning as a handle and a cover is separated from the refrigerator, the injection pipe and the discharge pipe may also be separated, and a user may easily wash the injection pipe and the discharge pipe.

The injection pipe and the discharge pipe may extend in parallel with each other, the discharge pipe may extend up to or close to a bottom of the drink container, and the injection pipe may extend around the inlet of the drink container. Accordingly, high-pressure air or an unreactive gas may be supplied only to the inlet of the drink container and even a drink close to the bottom of the drink container may be discharged.

A connection assembly may be disposed in the cabinet. The connection assembly may connect at least any one or more of a supply pipe and an injection pipe of a cover assembly, and a discharge pipe of the cover assembly and a dispenser nozzle to each other by at least partially moving when the cover assembly fixing the drink container is seated on an upper cover of the cabinet. Accordingly, when the drink container is received in the storage compartment with the inlet fitted to the cover assembly, the cover assembly may press the connection assembly and pipes may be connected.

The connection assembly may include a connection housing and an operation protrusion disposed in the connection housing and being pressed and moved by the cover assembly. When the connection pipes are moved up and down with operation of the operation protrusion, the connection pipes may respectively connect the supply pipe and the injection pipe of the cover assembly to each other and the discharge pipe of the cover assembly and the dispenser nozzle to each other. That is, when the connection assembly is pressed and operated, the injection pipe and the supply pipe may be naturally connected to each other and the discharge pipe and the dispenser nozzle may be naturally connected to each other.

A pair of symmetric operation plates may be disposed in the connection housing and the operation protrusion may be connected to a side of each of the operation plates, so when the operation protrusion is pressed by the cover assembly, the operation plates may be rotated and move the connection pipes connected to the opposite sides. Accordingly, one connection assembly may connect a pair of pipes at both sides.

The connection assembly may include an elastic member and the elastic member may elastically support the operation protrusion, so the operation protrusion may be ready in a standby state in which the operation protrusion may be pressed by the cover assembly.

The operation protrusion of the connection assembly may at least partially protrude from a seat of the upper cover of the cabinet in which the cover assembly fixing the inlet of the drink container may be seated, and when the cover assembly is seated in the seat, the operation protrusion may be pressed by the cover assembly. Accordingly, a user may not need to operate the connection assembly in person.

A cooler may be disposed behind the storage compartment in the cabinet and an air pump may be disposed close to a bottom of the cabinet behind the storage compartment, so it may be possible to use an empty space and reduce noise.

An inlet of the drink container may be fixed to a cover assembly, and an injection pipe being selectively connected to the air pump and a gas tank and the discharge pipe connected to the dispenser nozzle may be disposed in the cover assembly.

The cover assembly may include: a cover plate blocking an open hole of an upper cover when being locked and fixed to an edge of the open hole, and including the injection pipe and the discharge pipe; and a coupling unit protruding into the open hole from the cover plate and surrounding the inlet of the drink container. A handle may be rotatably coupled to the cover plate and may protrude in an opposite direction to the coupling unit.

The handle may have a protrusive cam portion that variably protrudes toward the coupling unit of the cover assembly when the handle is rotated with respect to the cover assembly, and the coupling unit may be at least partially movably disposed in the cover assembly and may compress a circumference of the inlet of the drink container by being compressed when the coupling unit is pushed and moved by the protrusive cam portion.

The refrigerator for drinks according to the present disclosure described above may have the following effects.

According to the present disclosure, an air pump for discharging a drink by increasing pressure of a drink container may be provided and a gas tank supplying an unreactive gas to prevent oxidation of a drink may be separately provided. An air pipe may selectively connect the air pump and the gas tank to a drink container. Accordingly, two functions of discharging a drink and preventing oxidation may be individually performed, so consumption of an unreactive gas may be reduced and the maintenance cost of the refrigerator for drinks may be reduced.

Since the air pump and the gas tank separated from each other may be connected to one supply pipe and selectively supplied to a drink container by a control valve, the structure of the pipes in the refrigerator for drinks may be simplified.

According to the present disclosure, the gas tank may be disposed on the top of the refrigerator for drinks, so when the door is opened, the gas tank may be immediately exposed. Accordingly, a user may easily replace the gas tank, so the user may conveniently use the refrigerator.

Since the air pump for increasing the pressure of a drink container may not be an expandable, so it may not be necessarily replaced. Accordingly, it may be possible to reduce noise by installing the air pump at the rear portion on the bottom of the cabinet.

According to the present disclosure, a drink container may be fitted in the cover assembly and stored in the storage compartment, and the cover assembly may include (i) an injection pipe connecting the air pump or the gas tank to a drink container and (ii) a discharge pipe connecting the dispenser nozzle to the drink container. Accordingly, when the cover assembly functioning as a handle and a cover is separated from the refrigerator, the injection pipe and the discharge pipe may also be separated, and a user may easily wash the injection pipe and the discharge pipe.

The discharge pipe, which may take up a drink from the drink container up to the dispenser nozzle, may occupy most of a drink discharge path, so it may be possible to improve washing efficiency by washing the discharge pipe of the cover assembly.

When the drink container is received in the storage compartment with the inlet fitted to the cover assembly, the cover assembly may press the connection assembly and pipes may be connected. Accordingly, when the connection assembly is pressed and operated, the injection pipe and the supply pipe may be naturally connected to each other and the discharge pipe and the dispenser nozzle may be naturally connected to each other. Although the injection pipe and the discharge pipe may be disposed in the detachable cover assembly rather than being fixed to the cabinet, the pipes may be connected to each other by a user only coupling the cover assembly to the refrigerator without manually connecting the pipes, which is very convenient.

Several storage compartments may be formed in the refrigerator and a drink container may be received in each of the storage compartments in the present disclosure. Diverging lines of the supply pipe may be respectively connected to the drink containers received in the storage compartments, whereby high-pressure air or an unreactive gas may be supplied. Accordingly, even if several drink containers are simultaneously received, it may be possible to prevent oxidation of a drink and a user may separately receive drinks from the drink containers.

According to the present disclosure, it may be possible to take out a drink container fitted in a cover assembly from the storage compartment or put the drink container into the storage compartment. Since the cover assembly may function as a kind of handle, so it may easy to take out and put in a drink container.

In particular, according to the present disclosure, when the handle of the cover assembly is rotated, the pressing unit may press the circumference of the inlet of a drink container in correspondence to the operation of the handle, whereby the drink container may be strongly fixed to the cover assembly. Accordingly, it may be possible to stably move a heavy drink container when putting the drink container into the storage compartment or taking out the drink container from the storage compartment.

BRIEF DESCRIPTION OF THE DRAWINGS

The above and other objectives, features and other advantages of the present disclosure will be more clearly understood from the following detailed description when taken in conjunction with the accompanying drawings, in which.

DETAILED DESCRIPTION OF THE INVENTION

Figure 1:
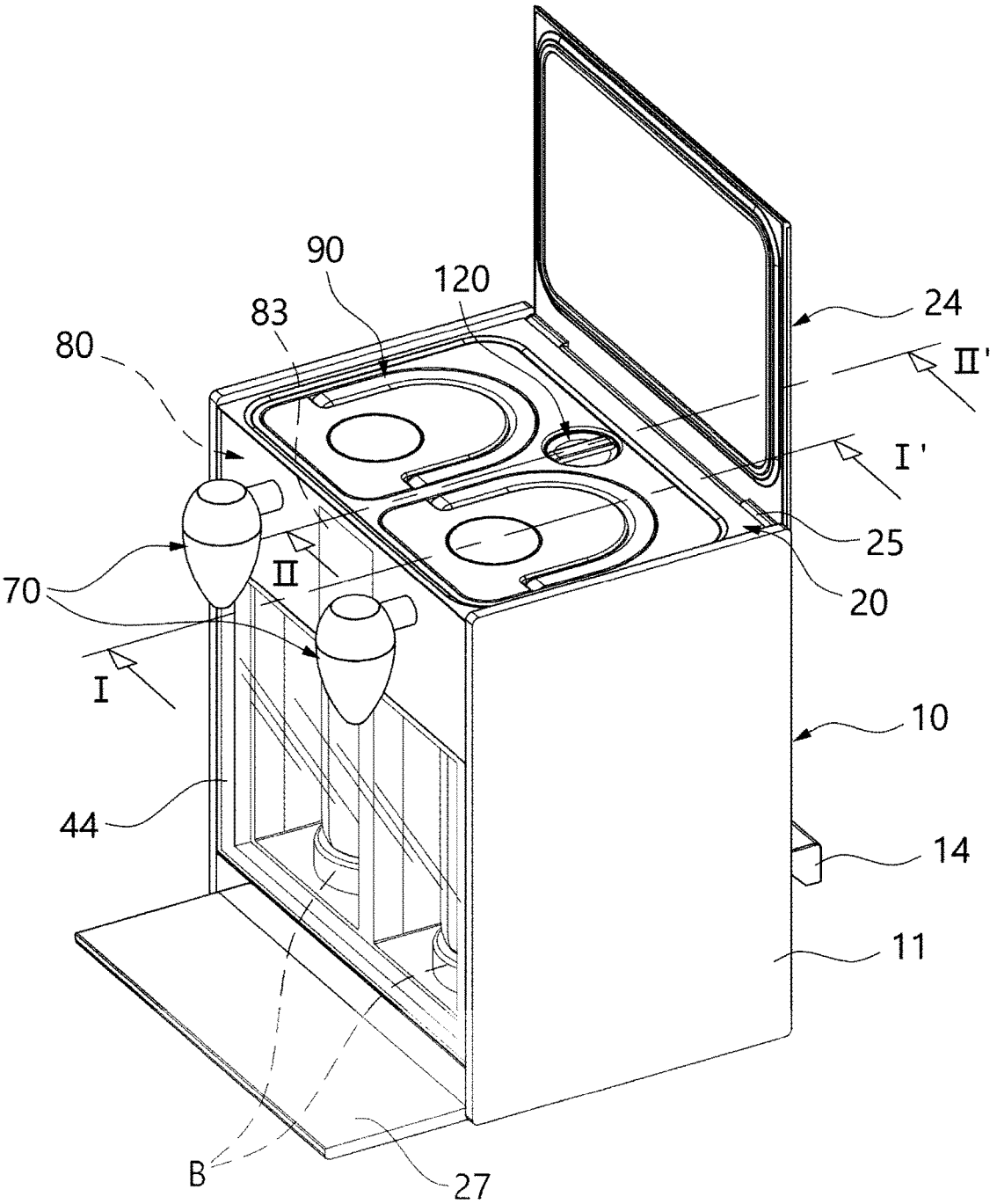
FIG. 1 is a perspective view showing the configuration of an embodiment of a refrigerator for drinks according to the present disclosure.

Hereinafter, some embodiments of the present disclosure are described in detail with exemplary drawings. It should be noted that when components are given reference numerals in the drawings, the same components are given the same reference numerals even if they are shown in different drawings. In the following description of embodiments of the present disclosure, when detailed description of well-known configurations or functions is determined as interfering with understanding of the embodiments of the present disclosure, they are not described in detail.

Terms 'first', 'second', 'A', 'B', '(a)', and '(b)' can be used in the following description of the components of embodiments of the present disclosure. These terms are provided only for discriminating components from other components and, the essence, sequence, or order of the components are not limited by the terms. When a component is described as being "connected", "combined", or "coupled" with another component, it should be understood that the component may be "connected", "combined" or "coupled" to another component directly or with another component interposing therebetween.

A refrigerator (hereafter, referred to as a 'refrigerator') of the present disclosure is described with reference to an embodiment. For reference, a refrigerator for keeping a drink container B that is vertically long such as a wine bottle is exemplified below, but the present disclosure may be applied to a refrigerator that may cool various drinks in bottles other than wine bottles.

Figure 2:
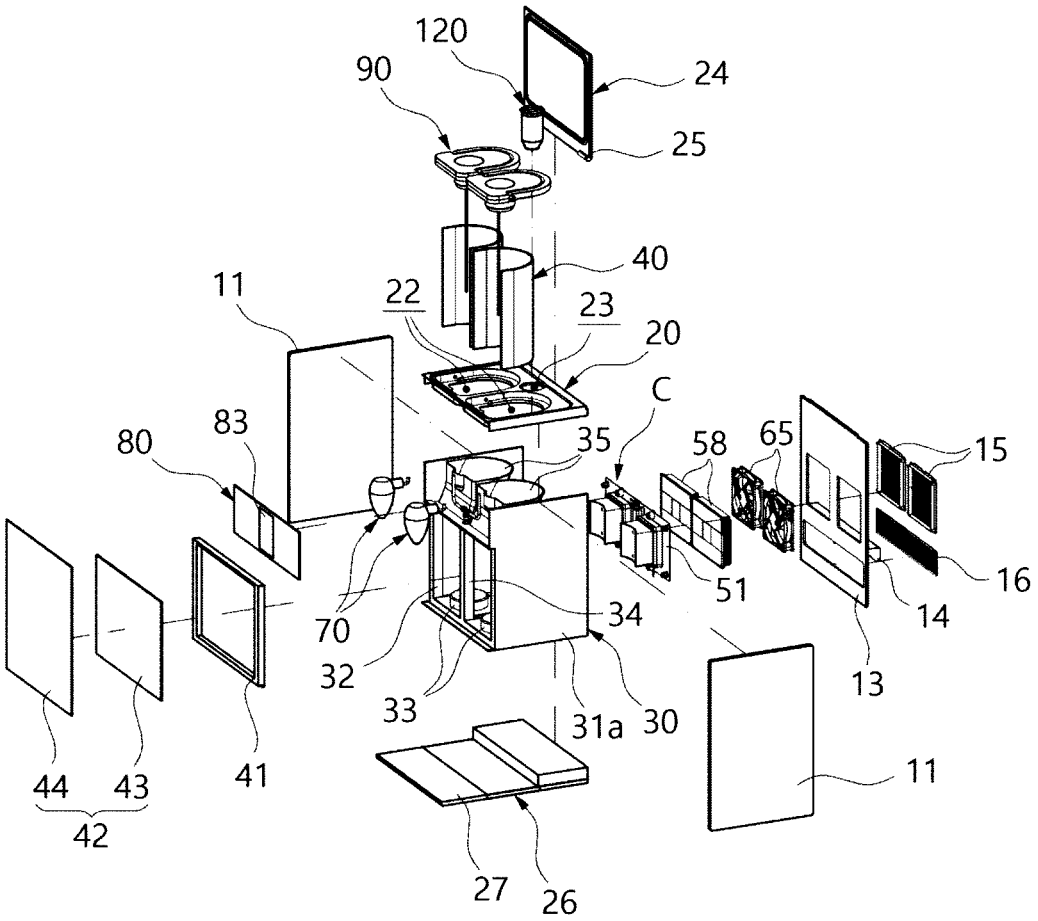
FIG. 2 is an exploded view showing parts of an embodiment of the present disclosure.

Referring to FIGS. 1 and 2, a cabinet 10, which forms the external appearance of a refrigerator, as shown in the figures, is formed such that the front-rear width is relatively short. As described above, the refrigerator according to the embodiment may have a small bottom area, so there is no need for a large installation area. Accordingly, the refrigerator may be placed on the floor or may be installed on a table.

In the embodiment, the cabinet 10 may have a substantially hexahedron shape and may have an installation space S (see FIG. 3), and an inner casing 30 and a cooler C to be described below may be installed in the installation space S. A storage compartment 32 may be formed inside the inner casing 30 and the drink container B may be accommodated in the storage compartment 32.

Referring to FIG. 2, the state in which the parts of the cabinet 10 have been disassembled is shown in FIG. 2. The cabinet 10 may include a pair of side plates 11, a rear plate 13, an upper cover 20, and a lower cover 26. The pair of side plates 11, rear plate 13, upper cover 20, and lower cover 26 may be assembled, thereby forming the installation space therein and forming the external appearance of the refrigerator. An insulating panel 42 to be described above may be disposed on the front surface of the cabinet 10, which will be described below.

As for the rear plate 13 of the cabinet 10, an air intake port and an air discharge port may be formed in the rear plate 13. The air intake hole may be a part through which external air is taken inside and the air discharge port may be a part through which the air in the refrigerator is discharged outside. In the embodiment, the air intake port may be formed at an intake grille 15 coupled to the rear plate 13 and the air discharge port may be formed at a discharge grille 16 coupled to the rear plate 13. Obviously, the air intake port and the air discharge port may be directly formed at the rear plate 13 without the intake grilles 15 and the discharge grille 16.

The rear plate 13 may have a spacer 14. The spacer 14 may protrude outward, that is, away from the installation space of the refrigerator from the rear plate 13. The spacer 14, which is provided to keep a distance between the rear plate 13 and the wall of an installation place where the refrigerator is installed, may be elongated to the left and right, as shown in FIG. 2. The spacer 14 may naturally form an air flow space between the rear plate 13 and the wall of an installation place. The spacer 14 may function as a kind of handle. That is, a user may move the refrigerator with the spacer 14 by hand.

Referring to FIG. 2, the upper cover 20 may be disposed over the pair of side plates 11 and the rear plate 13 and may close the top of the installation space. In the embodiment, a door 24 of the refrigerator may be disposed on the top of the refrigerator and the upper cover 20 may function as a kind of frame on which the door 24 is installed.

Figure 15A:
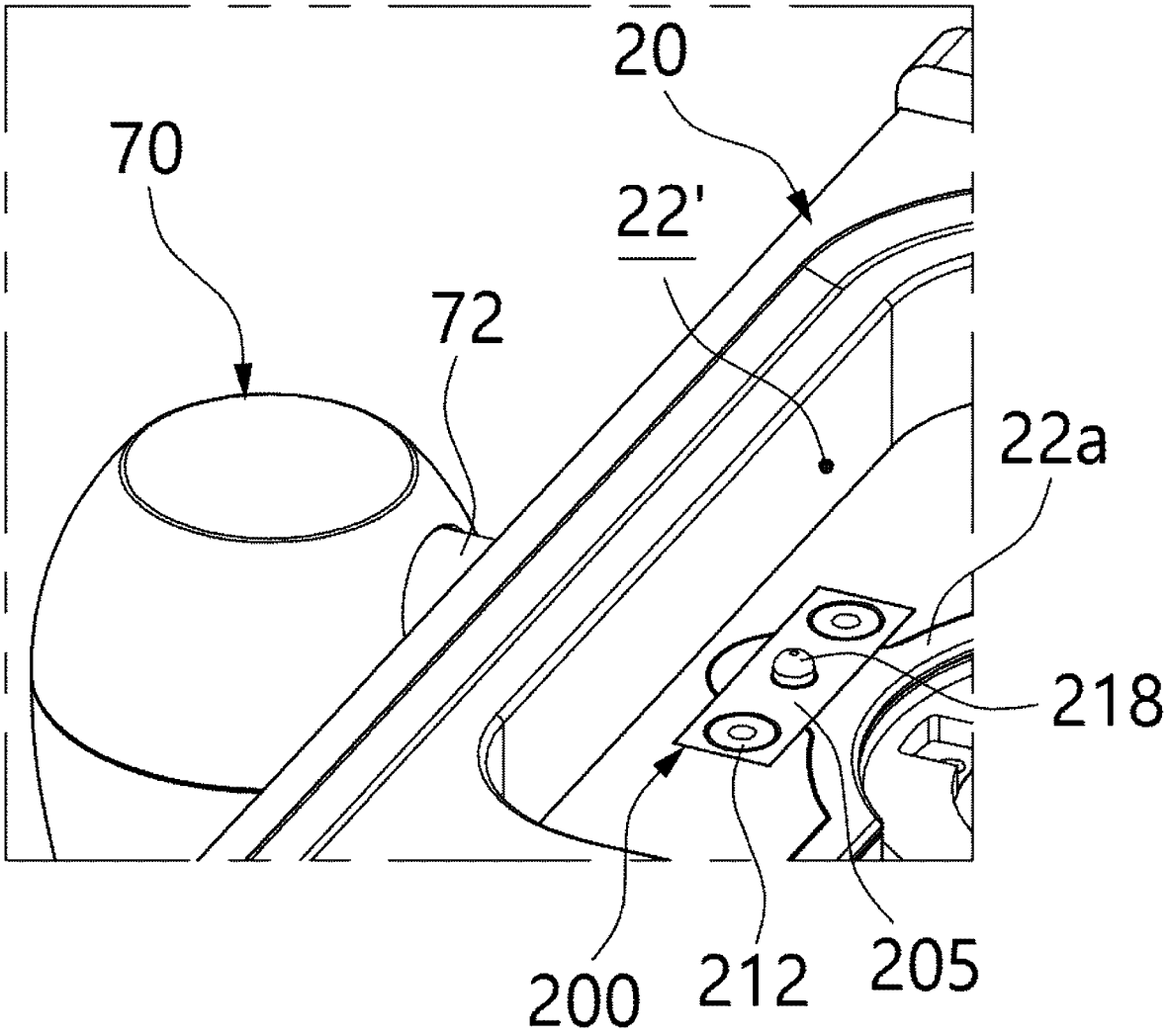
FIGS. 15A and 15B are operational state views showing a process of the operation of the connection assembly of an embodiment of the present disclosure.
Figure 15B:
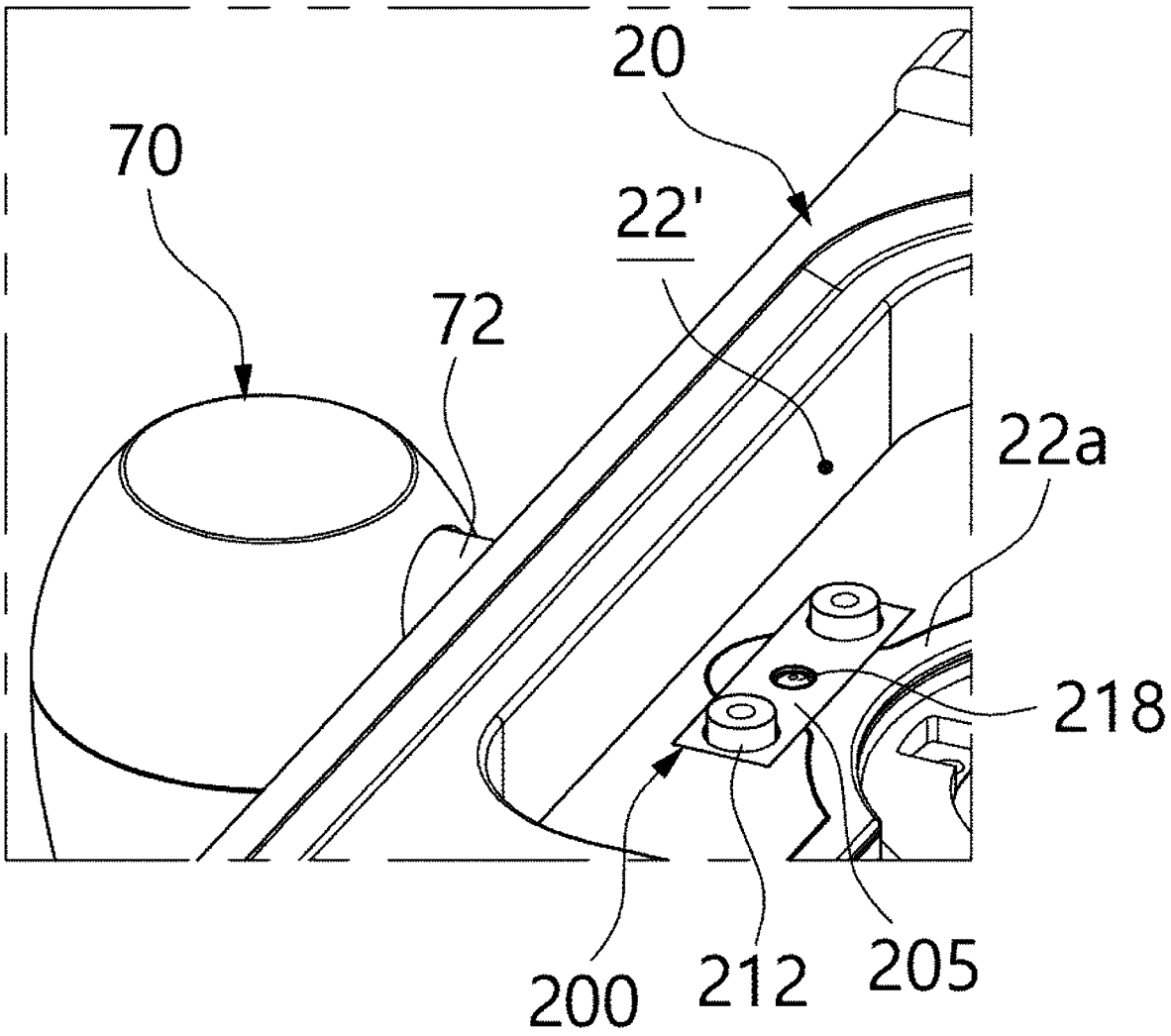

An open hole 22 may be formed through the center of the upper cover 20. The open hole 22 may be connected to a storage compartment 32 to be described below and may function as a kind of entrance exposing the storage compartment 32 to the outside when the door 24 is opened. Referring to FIGS. 15A and 15B, an inlet gasket 22*a* is disposed around the open hole 22. The inlet gasket 22*a* may close the portion around the open hole 22 when a cover assembly 90 is coupled.

The door 24 may be disposed on the upper cover 20. The door 24, which is provided to selectively open the open hole 22, may be rotatably coupled to the upper cover 20 through a hinge 25 in the embodiment. The door 24 is open in FIG. 1 and is closed in FIG. 4. Alternatively, the door 24 may be coupled to the upper cover 20 in a sliding type or the open hole 22 may be closed only by a cover assembly 90 to be described below without the door 24.

The lower cover 26 may be disposed at the bottom of the cabinet 10 that is the opposite side to the upper cover 20. The lower cover 26 may form the bottom of the cabinet 10 and may have a plane structure. The lower cover 26 may provide a surface on which the refrigerator is installed, and the bottom of the lower cover 26 may be a plane.

The lower cover 26 has a support plate 27. The support plate 27 may protrude forward from the lower cover 26 and may be considered as a part of the lower cover 26. The support plate 27 may be disposed at a position facing a dispenser nozzle 70 to be described below. Accordingly, when a drink is discharged through the dispenser nozzle 70 with a cup on the support plate 27, the cup may be filled with the drink.

An inner casing 30 may be disposed in the cabinet 10. The inner casing 30 may be disposed in the installation space of the cabinet 10 to be surrounded by the cabinet 10. The storage compartment 32 may be formed in the inner casing 30 and the drink container B may be accommodated in the storage compartment 32. Although the inner casing 30 and the cabinet 20 may be separate parts, the inner casing 30 may be integrated with the cabinet 10 or may not be provided.

The inner casing 30 may have a three-dimensional structure surrounding the storage compartments 32 with respect the storage compartment 32 at the center. The inner casing 30 may have substantially a hexahedron shape in the embodiment, but is not limited thereto. The inner casing 30 may be entirely or at least partially made of a nonmetallic material. In the embodiment, other portion excluding cooling guides 40 coupled to the inner casing 30 may be made of a nonmetallic material such as synthetic resin.

The frame of the inner casing 30 may be formed by a pair of sides 31*a* (see FIG. 2) and a bottom 31*b* (see FIG. 4) connecting the sides 31*a* and forming the floor. Holders 35 may be disposed inside the inner casing 30 surrounded by the pair of sides 31*a* and the bottom 31*b*. The holder 35 may surround at least a portion of the drink container B and the storage compartment 32 may be formed inside the holder 35.

Figure 3:
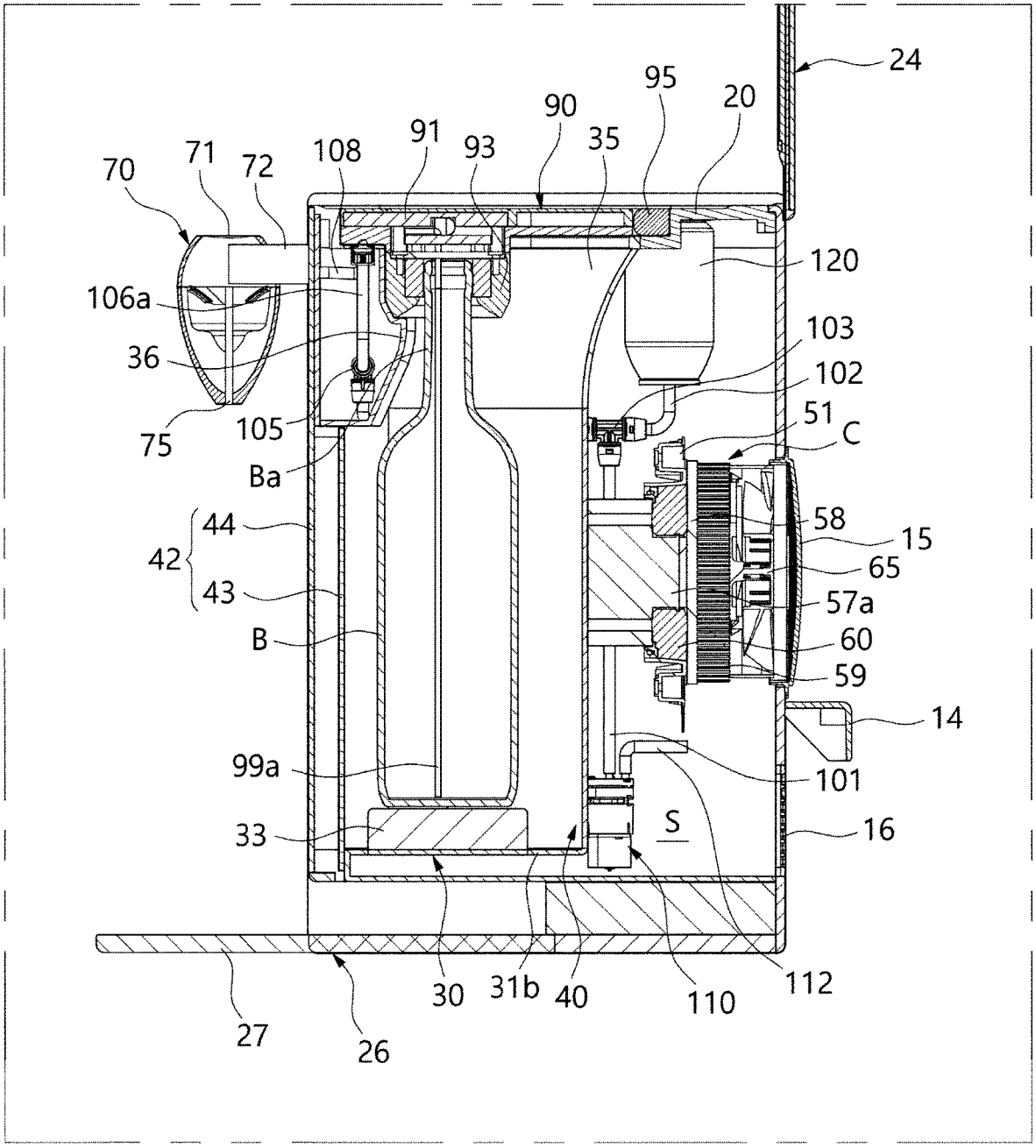
FIG. 3 is a cross-sectional view taken along line I-I' of FIG. 1.

As shown in FIG. 3, a bed 33 may be disposed on the bottom 31*b*. The bed 33 may protrude toward the storage compartment 32 from the bottom 31*b* in a substantially cylindrical shape. The bed 33 may be a part that supports the bottom of the drink container B. Though not shown in the figures, the bed 33 may have a spring, so the bed 33 may be elastically supported by the spring.

In the embodiment, the holders 35 may be positioned between the pair of sides 31*a* close to the top of the inner casing 30. The holders 35 may extend downward and may be connected to the cooling guide 40 at the lower end. A partition wall 34 may be disposed between the pair of accommodating bodies 35. The partition wall may be a part vertically extending and separating two storage compartments 32. The partition wall 34 may meet the cooling guide 40 to be described below at an end, thereby serving to support the cooling guide 40.

The holder 35 may have an inclined portion 36 and the inclined portion 36 may be a surface that is inclined to decrease the width of the storage compartment 32 as it goes up, that is, goes toward the upper cover 20. Since the inclined portion 36 decreases the width of the storage compartment 32, the inclined surface 36 may go close to the inlet Ba having a relatively small width of the drink container B. Since the inclined portion 36 decreases the width of the upper portion of the storage compartment 32, the volume of the storage compartment 32 may also be decreased, whereby the storage compartment 32 may be more effectively cooled. The outer side, that is, the opposite side to the storage compartment 32 of the inclined portion 36 may be filled with an insulator (not shown).

The cooling guide 40 may be coupled to the holder 35. The cooling guide 40 may form the storage compartment 32 inside by being coupled to the holder 35. Although the cooling guide 40 is separated from the inner casing 30 in FIG. 2, the cooling guide 40 has been coupled to the lower portion of the holder 35 inside the inner casing 30 in FIG. 3.

When the cooling guide 40 is coupled to the holder 35, the cooling guide 40 and the holder 35 may be continuously connected. Accordingly, the storage compartment 32 may be formed as one space by the holder 35 and the cooling guide 40. In the embodiment, if the holder 35 surrounds the inlet Ba, that is, the upper portion of the drink container B, the cooling guide 40 may surround the main body of the drink container B.

The cooling guide 40 may be configured to surround the storage compartment 32 and may serve to reduce the temperature of the storage compartment 32. The cooling guide 40 may be controlled in temperature by being directly connected to the cooler C to be described below. For example, when the temperature of the cooling guide 40 is decreased by operation of the cooler C, the temperature of the storage compartment 32 that is space inside the cooling guide 40 also decreases.

Meanwhile, the front surface of the inner casing 30 may be open and the storage compartment 32 may be open forward, and the open portions may be closed by the insulating panel 42. The insulating panel 42 may be disposed on the front surface of the inner casing 30 opposite to the cooler C with the storage compartments 32 therebetween and may be made of an insulating material in a flat plate structure. The detailed structure of the insulating panel 42 will be described below.

The storage compartments 32 formed in the inner casing 30 may be separated as independent spaces by the cooling guides 40 disposed in the inner casing 30. As described above, the storage compartment 32 may be formed by the cooling guide 40, the bottom 31*b*, and the insulating panel 42. Several storage compartments 32 share the bottom 31*b* and the insulating panel 42, but several cooling guides 40 are provided to separate the storage compartments 32.

Meanwhile, the front surface of the inner casing 30 may be open and the storage compartment 32 may be open forward, and the open portions may be closed by the insulating panel 42. The insulating panel 42 may be disposed on the front surface of the inner casing 30 opposite to the cooler C with the storage compartments 32 therebetween and may be made of an insulating material in a flat plate structure.

As for the insulating panel 42 forming a side of the insulating space, the insulating panel 42 may surround both of the cooling guides 40 and the storage compartments 32 disposed inside the inner casing 30. More specifically, the cooling guides 40, the insulating panel 42, and the bottom 31*b* may form the storage compartments 32 and the tops of the storage compartments 32 may be selectively closed by the cover assemblies 90 and the door 24.

Figure 4:
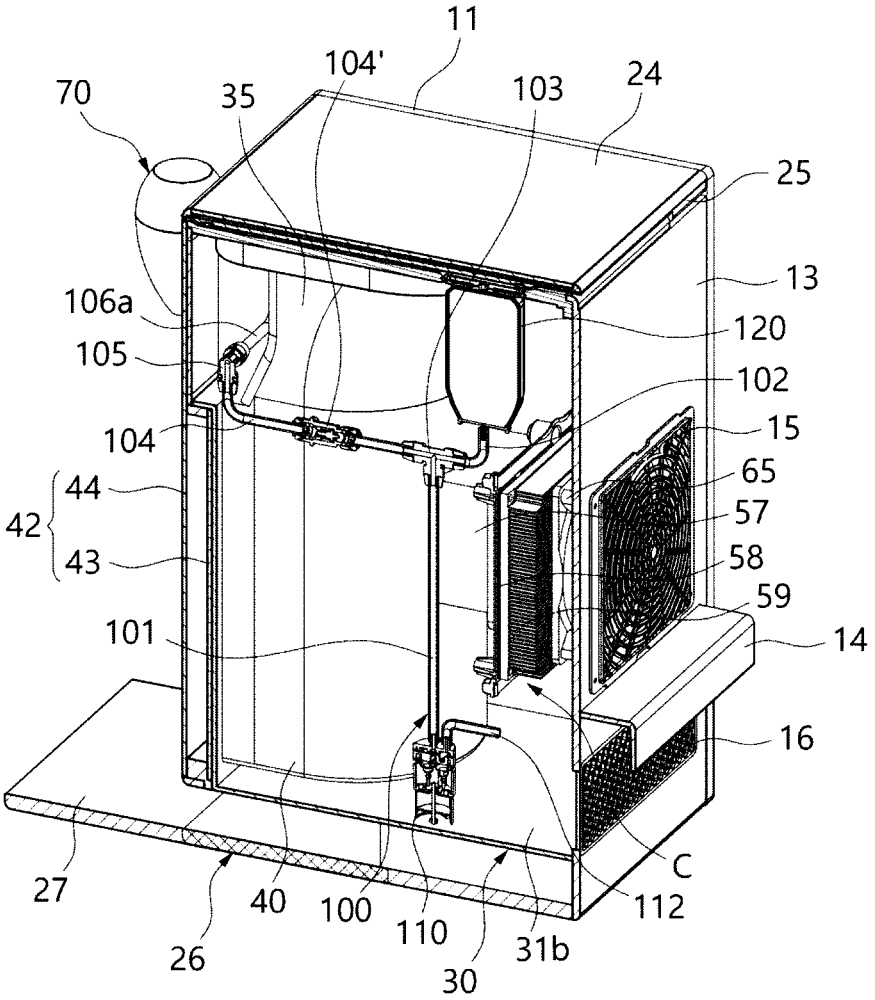
FIG. 4 is a cross-sectional view taken along line II-II' of FIG. 1.

FIG. 4 shows the structure of the insulating panel 42. As shown in the figure, the insulating panel 42 may be composed of at least one or more pieces of insulating glass. In the embodiment, the insulating panel 42 may be composed of a first panel 43 and a second panel 44. The first panel 43 and the second panel 44 may be fixed to a panel frame 41. For reference, the first panel 43 may be fixed inside the panel frame 41 and the second panel 44 may be fixed outside the panel frame 41.

The first panel 43 and the second panel 44 may be each insulating glass. Accordingly, a user may see the storage compartment 32 through the first and second transparent panels 43 and 44 and may observe the drink containers B in the storage compartment 32. A user may recognize the kinds of the drinks in the storage compartments 32 through the insulating panel 42. An empty space may be defined between the first panel 43 and the second panel 44 and the empty space may be a vacuum.

Next, the cooler C is described hereafter. The cooler C may be disposed in the installation space to reduce the temperature of the storage compartment 32. When the temperature of the storage compartment 32 decreases, the temperature of the drink container B in the storage compartment 32 also decreases. In the embodiment, the cooler C may be at least partially in contact with the inner casing 30 surrounding the storage compartments 32, whereby cooling performance may be increased.

As shown in FIG. 2, the cooler C may be disposed close to the storage compartment 32 to decrease the temperature of the storage compartment 32. The cooler C may be disposed at various positions except for the portion between the storage compartment 32 and the insulating panel 42. For example, the cooler C may be disposed at the left or right side of the storage compartment 32 or may be disposed behind the storage compartment 32.

As shown in FIG. 4, the cooler C may be disposed behind the storage compartment 32 opposite to the insulating panel 42. When the cooler C is disposed behind the storage compartment 32, one side of the cooler C may face the intake grille 15 and the discharge grille 16 of the rear plate 13, whereby cooling efficiency may be increased. Further, in the embodiment, since the widest installation space S may be secured behind the storage compartment 32, it may be easy to install the cooler C.

Several coolers C may be provided. More specifically, the number of the coolers C may be the same as the number of the storage compartments 32, and since two storage compartments 32 are provided in the embodiment, two coolers C are provided. The several coolers C may serve to separately decrease the temperature of the corresponding storage compartments 32. Accordingly, the internal temperatures of the several storage compartments 32 may be set at different levels, so the storage compartments may be independently cooled.

Figure 5:
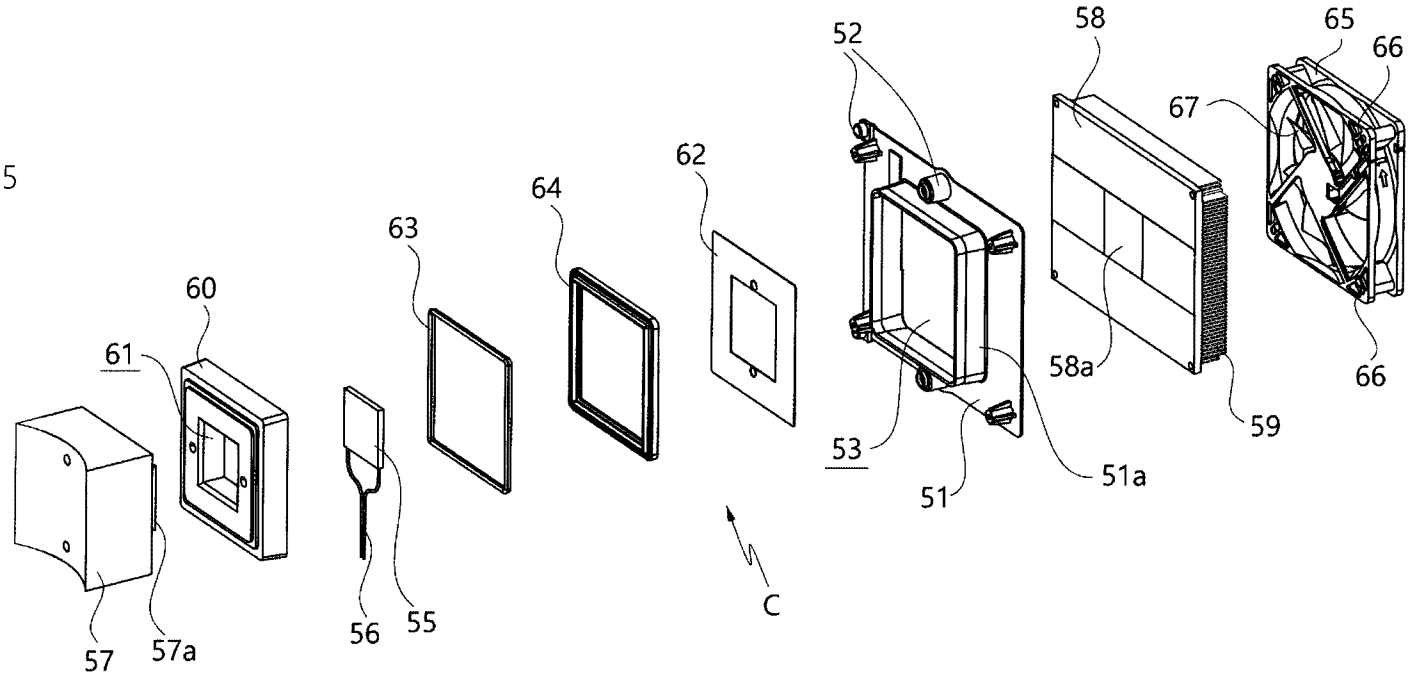
FIG. 5 is an exploded view showing a cooler of the parts of an embodiment of the present disclosure.

Referring to FIGS. 3 and 5, cold air generated by the cooler C may flow toward the cooling guide 40 and may cool the entire cooling guide 40 while flowing on the surface of the cooling guide 40. Further, the cooled cooling guide 40 may provide the cold air to the storage compartment 32. Accordingly, the storage compartment 32 may be cooled.

As for the configuration of the cooler C, the cooler C may include a thermoelectric element 55 and the thermoelectric element 55 may keep the temperature of the storage compartment 32 low using Peltier effect. The cooler C may have a structure connecting a low-temperature portion of the thermoelectric element 55 to the storage compartment and discharging heat from a high-temperature portion to effectively cool the storage compartment 32.

In detail, referring to FIG. 5, the cooler C may be formed by assembling several parts. The cooler C may include an element housing 51 and the element housing 51 may form the frame of the cooler C. The element housing 51 may be a kind of rectangular frame and a receiving space 53 may be formed through the center of the element housing 51. Several parts including the thermoelectric element 55 may be disposed in the receiving space 53. The receiving space 53 may be defined inside a frame portion 51*a* protruding toward the thermoelectric element 55 from the element housing 51. Reference numeral '52' indicates several fastening bosses for fixing the element housing 51, and some of the fastening bosses may couple other parts to the element housing 51.

The thermoelectric element 55 may be disposed in the receiving space 53. The thermoelectric element 55 may have a low-temperature portion and a high-temperature portion, and the low-temperature portion and the high-temperature portion may be determined in accordance with the direction of a voltage that is applied to the thermoelectric element 55. The low-temperature portion of the thermoelectric element 55 may be positioned closer to the cooling guide 40 than the high-temperature portion. The low-temperature portion may be in contact with the cooling block 57 to be described below and the high-temperature portion may be in contact with the heat sink 58. The cooling block 57 may cool the cooling guide 40 and heat may be dissipated from the heat sink 58. Reference numeral '56' indicates a cable for applying power to the thermoelectric element 55.

The cooling block 57 may be in contact with the thermoelectric element 55. The cooling block 57 may be disposed between the thermoelectric element 55 and the cooling guide 40 with one side in contact with the cooling block 57 and the opposite side in contact with the cooling guide 40. Accordingly, the cooling block 57 may transmit the coldness of the low-temperature portion of the thermoelectric element 55 to the cooling guide 40.

The cooling block 57 may have a protrusive pressing portion 57*a*. The pressing portion 57*a* may protrude toward the receiving space 53 of the element housing 51 from the cooling block 57 and may have a rectangular shape when seen from the front. The surface of the pressing portion 57*a* may be in close contact with the thermoelectric element 55. The pressing portion 57*a* may press the thermoelectric element 55 toward the heat sink 58, whereby the thermoelectric element 55 may be fixed between the pressing portion 57*a* and the heat sink 58.

The heat sink 58 may be disposed opposite to the cooling block 57 with the thermoelectric element 55 therebetween. The heat sink 58 may be in contact with the high-temperature portion 55, thereby serving to dissipate heat of the high-temperature portion of the thermoelectric element 55. A heat dissipation fan 65 to be described below may be coupled to the heat sink 58, whereby the heat dissipation fan 65 may cool the heat sink 58.

As for the structure of the heat sink 58, the heat sink 58 may include a heat dissipation plate (not given reference numeral) and a plurality of heat dissipation fins 59. The heat dissipation fins 59 may be stacked with gaps therebetween. The heat dissipation plate may be a thin plate and may be in contact with the heat dissipation fins 59.

The heat dissipation plate may further include an element contact plate 58*a* for contact with the thermoelectric element 55. The area of the element contact plate 58*a* may be smaller than the area of the heat dissipation plate. For example, the element contact plate 58*a* may have a surface area that is substantially the same as the surface of the thermoelectric element 55. The element contact plate 58*a* may be exposed to the thermoelectric element 55 through the receiving space 53 of the element housing 51.

The cooler C may further include an insulating frame surrounding the thermoelectric element 55. The thermoelectric element 55 may be positioned inside the insulating frame 60. The insulating frame 60 has an element mount hole 61 open forward and rearward and the thermoelectric element 55 may be positioned in the element mount hole 61.

A gasket 63 may be disposed at the close contact portion between the insulating frame 60 and the cooling block 57. The gasket 63 may have an elastic material such as rubber. The gasket 63 may be formed in a rectangular ring shape, but is not limited thereto and the shape thereof may be changed in accordance with the shape of the insulating frame 60. The gasket 63 may function as a sealing member and may prevent heat from being dissipated between the insulating frame 60 and the cooling block 57. Reference numeral '64' indicates a holder for fixing the gasket 63.

A back plate 62 may be disposed on the rear surface of the insulating frame 60. The back plate 62 may be combined with the insulating frame 60 to surround the edge of the thermoelectric element 55. The back plate 62, similar to the insulating frame 60, may serve to increase the efficiency of cooling the thermoelectric element 55 by preventing the heat of the thermoelectric element 55 from being conducted to the edge of the thermoelectric element 55. The back plate 62 may be positioned in the receiving space 53 of the element housing 51.

The heat dissipation fan 65 may be coupled to the rear of the heat sink 58. The heat dissipation fan 65 may be disposed to face the heat sink 58 and may blow external air flowing inside through the air intake port to the heat sink 58. The heat dissipating fan 65 may include a fan 67 and a fan housing surrounding the outer side of the fan 67. The fan 67, for example, may be an axial fan. The fan 67 may be spaced apart from the heat sink 58. Accordingly, the flow resistance of the air blown by the heat dissipating fan 65 may be minimized and heat exchange efficiency at the heat sink 58 can be increased. The heat dissipating fan 65 can be fixed to the heat sink 58 by a fixing pin 66.

Meanwhile, unlike the previous embodiment, the cooler C may cool the storage compartment 32 by discharging cold air into the storage compartment 32 without directly cooling the cooling guide 40. In this case, the cooling guide 40 may not be necessarily made of a metallic material having high thermal conductivity and may be integrated with the inner casing 30 or may not be provided.

Referring to FIG. 3, the cabinet 10 may have a dispenser nozzle 70. The dispense nozzle 70 may be a part that dispenses a drink from the drink container B in the storage compartment 32, and may be disposed on the front surface of the cabinet 10 in the embodiment. The same number of dispenser nozzles 70 as the number of storage compartments 32 may be provided, and two dispenser nozzles 70 may be provided in the embodiment. The dispenser nozzles 70 may be used to supply the drinks in the drink containers B in different storage compartments 32, respectively. Alternatively, all or some of the dispenser nozzles 70 may be disposed on a side of the cabinet 10.

The dispenser nozzle 70 may include a nozzle connection pipe 72 connected to the cabinet 10 and a dispenser head 71 connected to the nozzle connection pipe 72 and extending in the height direction of the refrigerator. A drink outlet 75 may be formed inside the dispenser head 71, so the drink in the drink container B may be supplied through the drink outlet 75. For reference, when the internal pressure of the drink container B is increased by injecting air into the drink container B, the drink in the drink container B may be supplied outside through the nozzle connection pipe 72 and the drink outlet 75, and this structure will be described below.

As described above, the dispenser nozzles 70 may be disposed on the insulating panel 42 at the front rather than on the top of the cabinet 10 in the embodiment. This may be possible because there may be no door on the front surface of the cabinet 10 and the front surface may be formed by the insulating panel 42. More specifically, when the door 24 is disposed on the front surface of the cabinet 10, the door 24 may interfere with the dispenser nozzles 70 when it is opened and closed. However, since the door 24 may be disposed at the upper cover 20 rather than the front surface of the cabinet in the embodiment, there may be no possibility of the dispenser nozzles 70 being interfered with when the door 24 is opened and closed.

A front panel 80 is disposed close to the dispenser nozzles 70 and a display 83 may be disposed on the front panel 80. The front panel 80 may be disposed at the upper portion on the front surface of the cabinet 10 and may have a flat plate shape. In the embodiment, the front panel 80 may be positioned inside the second panel 44 positioned relatively outside of the insulating panel 42 described above, but the second panel 44 may be vertically shorter than the front panel 80 and the other portion may be filled with the front panel 80.

The display 83 may be disposed on the front panel 80. The display 83 may provide the information of the refrigerator or may provide an interface for inputting instructions, and in the embodiment, the display 83 may be a type enabling touch input. Various items of information such as the temperatures of the storage compartments 32, the storage periods of the stored drinks, and the kinds of drinks may be displayed through the display 83. A user may input temperatures of the storage compartment 32, internal brightness, turning-on/off of the refrigerator, etc. through the display 83.

The inlet Ba of the drink container B may be fitted to the cover assembly 90 in an open state. The cover assembly 90 may serve to close the inlet Ba of the drink container B and to close the open hole 22 at the center of the upper cover 20. When a user lifts the cover assembly 90, the drink container B fitted to the cover assembly 90 may also be taken out of the storage compartment 32, or a user may fit the drink container B to the cover assembly 90 and then may insert the drink container B into the storage compartment 32. Accordingly, the cover assembly 90 may function as a kind of handle.

FIG. 3 is a cross-sectional view showing the cover assembly 90 pressing and closing the inlet B1 of the drink container B. As described above, when the inlet Ba of the drink container B is fitted in the cover assembly 90, the inlet Ba of the drink container B may be strongly fixed and the drink container B may be kept in the storage compartment 32 with the inlet Ba fitted in the cover assembly 90. The cover assembly 90 itself may have the structure for pressing the inlet Ba of the drink container B.

Figure 6:
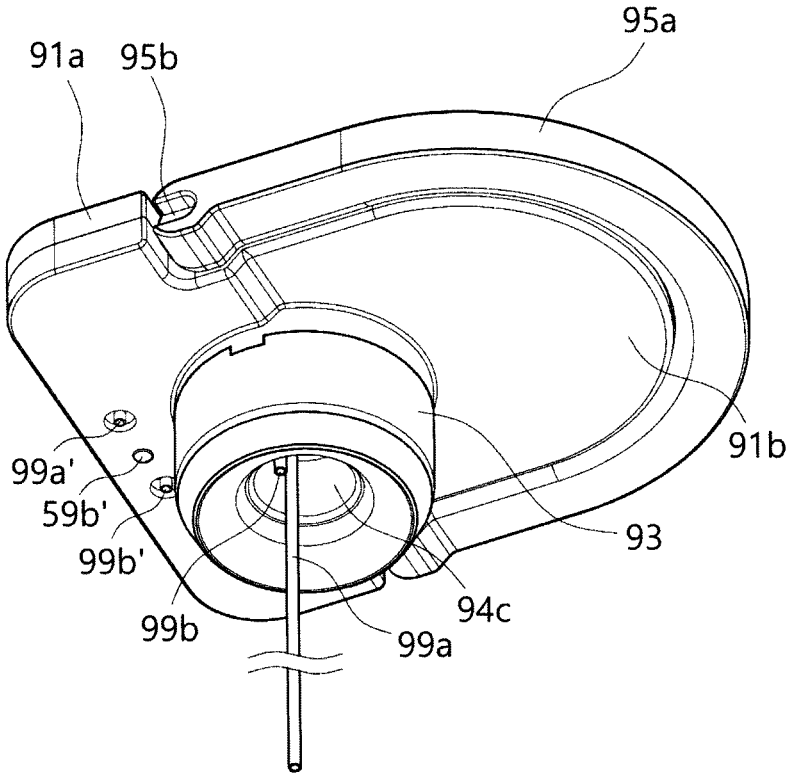
FIG. 6 is a perspective view showing the configuration of a cover assembly according to an embodiment of the present disclosure.
Figure 7:
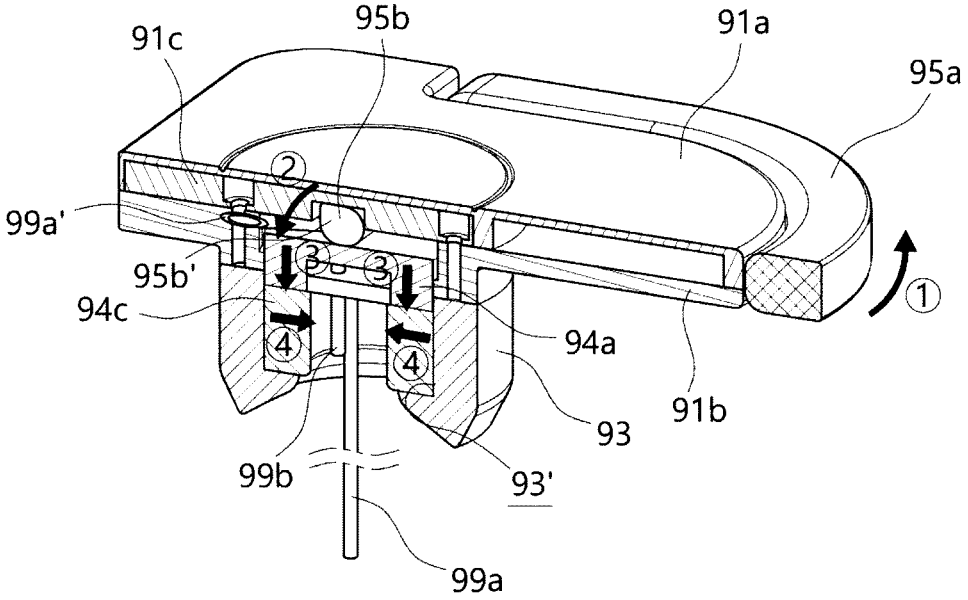
FIG. 7 is a cross-sectional view showing the internal configuration of a cover assembly according to an embodiment of the present disclosure.

FIGS. 6 and 7 are a perspective view and a cross-sectional view showing the cover assembly 90. As for the configuration of the cover assembly 90, the cover assembly 90 may have a cover plate 91 configured to close the open hole 22, and a coupling portion 93 extending downward from the cover plate 91 to have the inlet Ba of the drink container B fitted therein. A handle 95 may be rotatably coupled to the cover plate 91, so when the handle 95 is rotated upward (see FIGS. 11 and 12), a user may hold the handle.

In more detail, the cover plate 91 may be a portion that is locked and fixed to the edge of the open hole 22 of the upper cover 20, and the cover plate 91 may substantially have a plate shape in the embodiment. A side of the cover plate 91 may be formed in a rectangular shape and the other side may be formed in an arc shape, so the cover plate 91 may have an asymmetric shape. The other side formed in an arc shape of the cover plate 91 may be surrounded by the handle 95.

The cover plate 91 may cover the open hole 22 and the portion around the open hole 22, so when the cover assembly 90 is combined with the upper cover 20, the cover assembly 90 may function as a kind of internal door. When the cover assembly 90 is combined with the upper cover 20, the cover assembly 90 may not be moved at the position, so the inlet Ba of the drink container B fitted in the cover assembly 90 may also be naturally fixed in position. In particular, as shown in FIGS. 15A and 15B, a seat 22' around the open hole 22 and the cover plate 91 may be formed in shapes corresponding to each other and the cover plate 91 may have a front-rear asymmetric structure, as described above, so there may be no possibility of misassembly.

The coupling portion 93 may be disposed at a lower portion of the cover plate 91 may protrude downward from the cover plate 91 and may be slightly inserted in the open hole 22, in detail, in the storage compartment 32. The inlet Ba of the drink container B may be fitted in the coupling portion 93, whereby it may be closed.

Figure 11:
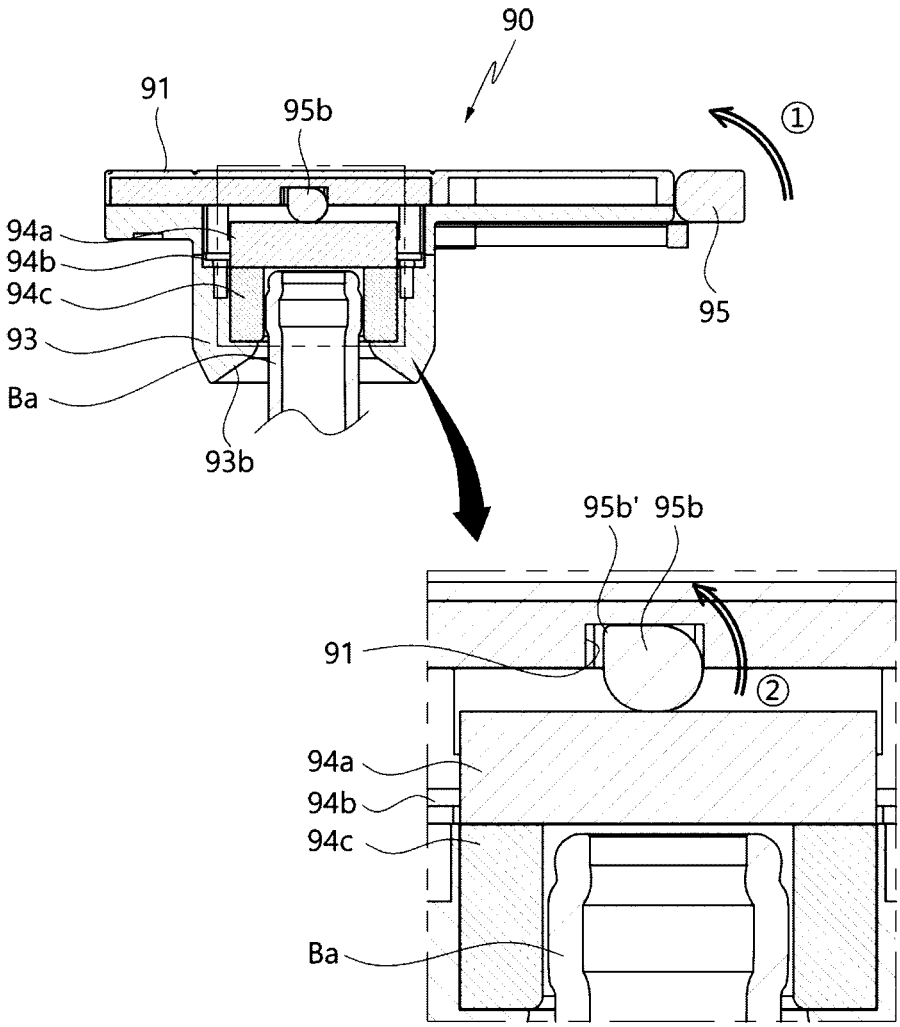
FIGS. 11 and 12 are cross-sectional views showing the internal structure of a cover assembly that is operated with rotation of a handle of the cover assembly of an embodiment of the present disclosure.
Figure 12:
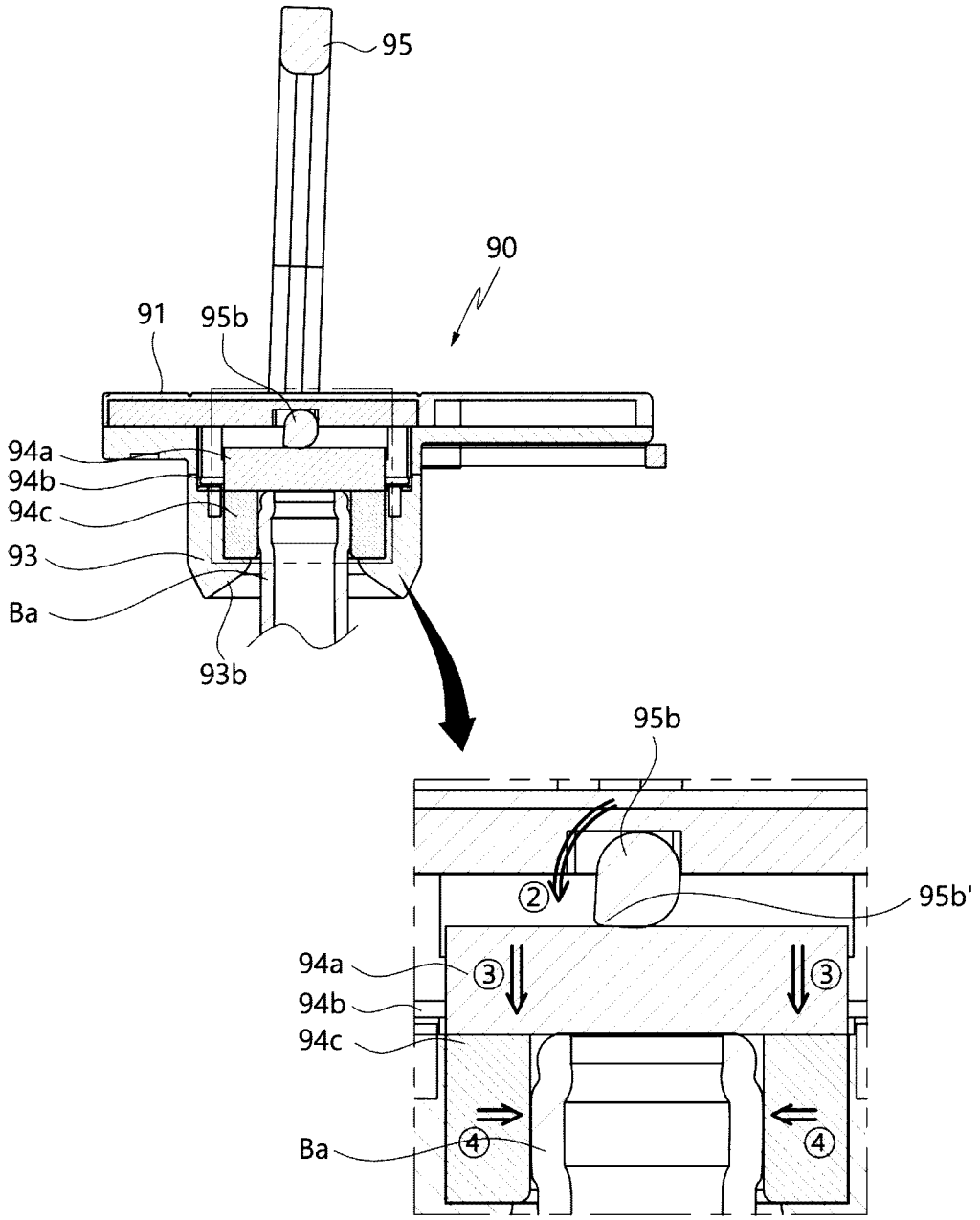

The handle 95 may be erected to move the drink container B fitted in the cover assembly 90, as shown in FIGS. 11 and 12, but may be rotated to form a continuous plane with the cover plate 91 after the drink container B is received in the storage compartment 32. That is, the handle 95 may be considered as a part of the cover plate 91.

When the handle 95 is rotated upward, as shown in FIGS. 11 and 12, a portion of the handle 95 may deform the coupling portion 93, whereby the inlet Ba of the drink container B may be strongly pressed and fixed in the coupling portion 93, and the detailed structure will be described below.

In the embodiment, the handle 95 may have protrusive cam portions 95*b*' that may variably protrude toward the coupling portion 93 of the cover assembly 90 when the handle 95 is rotated about the cover assembly 90. When the coupling portion 93 is pushed and moved by the protrusive cam portion 95*b*', the protrusive cam portions 95*b*' may be compressed, thereby pressing the portion around the inlet Ba of the drink container B.

Figure 8:
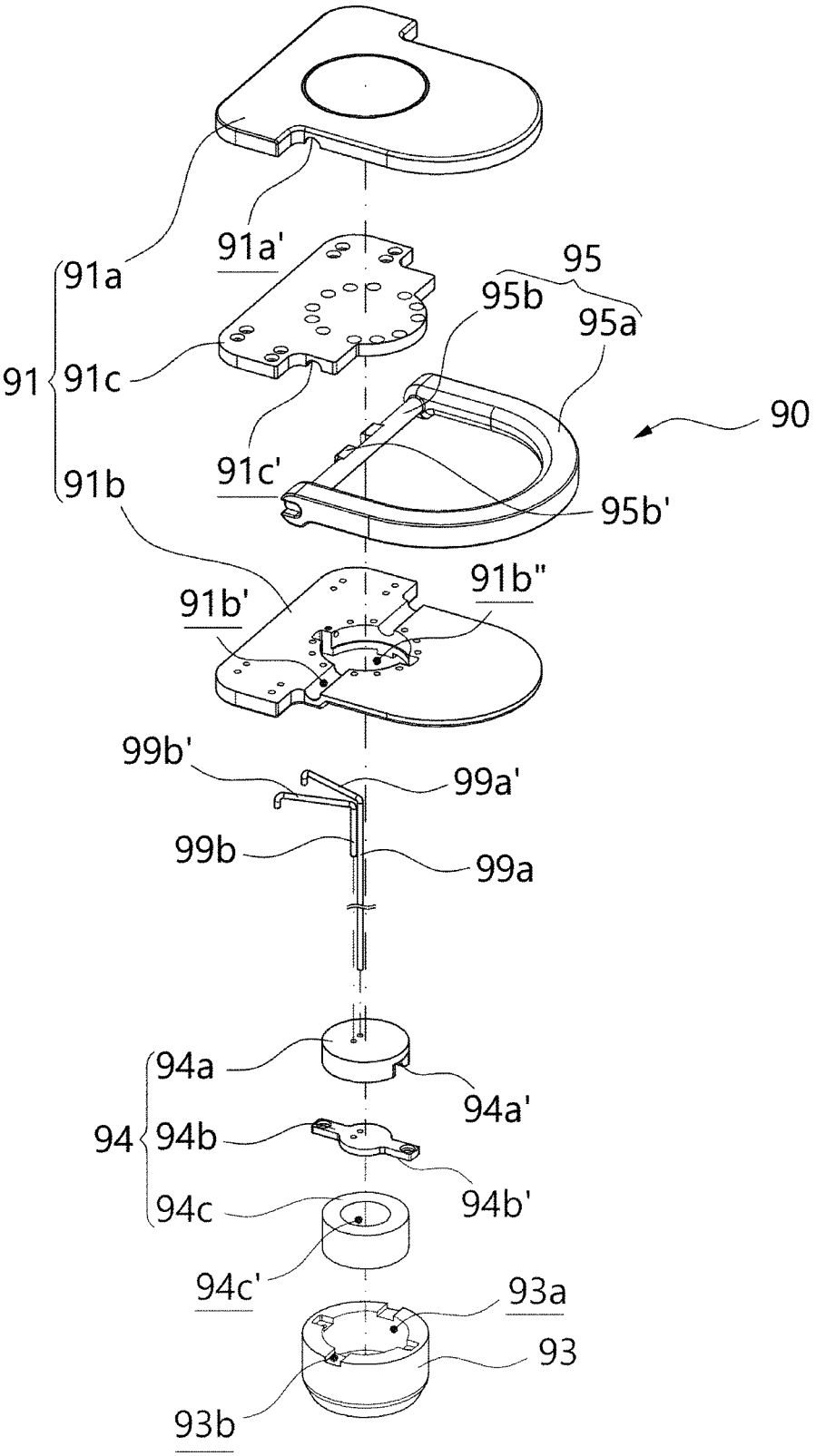
FIG. 8 is an exploded view showing parts of an embodiment of the present disclosure.

FIG. 8 is an exploded view showing the components of the cover assembly 90. As shown in the figure, the cover plate 91 of the cover assembly 90 may be composed of three parts in a broad meaning. The cover plate 91 may be formed by assembling a first plate 91*a* at the highest position and a second plate 91*b* at the lowest position, and an insulating block 91*c* may be inserted between the first and second plates. The insulating block 91*c* may be made of various materials such as polyurethane resin or aero gel, whereby the cover assembly 90 itself may function as an internal door. The insulating block 91*c* may be formed by filling an insulator between the first plate 91*a* and the second plate 91*b*.

The handle 95 may be inserted between the first plate 91*a* and the second plate 91*b* and has to be rotatably coupled, so a first rotary shaft groove 91*a*' and a second rotary shaft groove 91*b*' may be formed at the portions facing each other of the first plate 91*a* and the second plate 91*b*, respectively. The first rotary shaft groove 91*a*' and the second rotary shaft groove 91*b*' may be fit to each other, thereby forming a substantially circular long channel. A rotary shaft 95*b* of the handle 95 may be inserted in the channel. Obviously, a rotational groove 91*c*' in which the rotary shaft 91*b* of the handle 95 may be fitted may also be formed at the insulating block 91*c*.

An operation hole 91*b*" may be formed through the center of the second plate 91*b*. The operation plate 91*b*" may be an empty space defined vertically through the center of the second plate 91*b* and the protrusive cam portion 95*b*' on the rotary shaft 95*b* of the handle 95 may be positioned in the operation hole 91*b*". The protrusive cam portions 95*b*' may press a pressing block 94*a* to be described below while protruding downward through the operation hole 91*b*".

A coupling unit 93 and a pressing unit 94 may be coupled to the cover plate 91. The coupling unit 93 and the pressing unit 94 may protrude from the bottom of the cover plate 91 to surround the inlet Ba of the drink container B and may strongly press the surface of the inlet Ba of the drink container B rather than simply surrounding the inlet Ba of the drink container B such that the drink container B is not separated from the cover assembly 90.

In detail, the coupling unit 93 may function as a kind of housing and the pressing unit 94 may be inserted in the coupling unit 93. More specifically, the pressing unit 94 may be interposed between a coupling space 93*a* at the center of the coupling unit 93 and the cover plate 91. The pressing unit 94 may be disposed in the coupling space 93*a* and the inlet Ba of the drink container B may be fitted inside the pressing unit 94.

The pressing unit 94 may be disposed between the cover plate 91 and the coupling unit 93 such that at least a portion thereof may move toward the bottom of the coupling unit 93 from the cover plate 91. The pressing unit 94 may be moved and elastically deformed by the protrusive cam portions 95*b*' of the rotary shaft 95*b*, thereby pressing the inlet Ba of the drink container B.

In detail, according to this structure, the pressing unit 94 may include a pressing block 94*a*, a fixing plate 94*b*, and a compression block 94*c*. The pressing block 94*a* may be disposed to move up and down between the cover plate 91 and the coupling unit 93. The pressing block 94*a* may be pressed toward the bottom of the coupling unit 93 by the protrusive cam portions 95*b*' of the handle 95. That is, when the handle 95 is rotated, the pressing block 94*a* may be correspondingly moved downward.

The pressing block 94*a* may elastically deform the compression block 94*c* by moving down, that is, moving toward the compression block 94*c* when the handle 95 is operated. The descending distance of the pressing block 94*a* may be sufficient as long as the pressing block 94*a* can press and elastically deform the compression block 94*c*, so the actual ascending and descending distances of the pressing block 94*a* may not that large.

The pressing block 94*a* may have a substantially cylindrical shape and may be made of synthetic resin or metal, and a material having large strength and small elastic deformation may be better. A locking groove 94*a*' may be formed at the pressing block 94*a* and a fastening arm 94*b*' of the fixing plate 94*b* may be inserted in the locking groove 94*a*'.

The compression block 94*c*, which may be pressed and elastically deformed by the pressing block 94*a*, may be made of a material that is easily elastically deformed such as rubber or silicon. Since the compression block 94*c* should surround the inlet Ba of the drink container B, a compression hole 94*c*' may be formed through the center thereof. Further, since the compression block 94*c* may be supposed to be pressed by the bottom of the pressing block 94*a*, the diameter thereof may be close to the diameter of the pressing block 94*a*.

The pressing block 94*c* may be disposed in a coupling space 93*a* of the coupling unit 93. The compression block 94*c* may be pressed and elastically deformed by the pressing block 93*a* in the coupling space 93*c*, the compression block 94*c* may not be elastically deformed in the direction in which the diameter increases and may be necessarily elastically deformed in the direction in which the diameter of the compression hole 94*c*' decreases. Accordingly, when the compression block 94*c* is elastically deformed, the inlet Ba of the drink container B may be firmly fitted in the compression hole 94*c*', so the cover assembly 90 and the drink container B may be strongly coupled to each other.

Fastening grooves 93*b* may be formed on the top of the coupling unit 93*c*. The fastening grooves 93*b* may be recessed on the top of the coupling portion 93 and the fastening arm 94*b*' of the fixing plate 94*b* may be fastened thereto. When the fixing plate 94*b* is fitted in the fastening grooves 93*b* of the coupling unit 93, the fixing plate 94*b* may be maintained in the fixed state, and accordingly, the ascending height of the pressing block 94*a* may be limited. The fastening arm 94*b*' of the fixing plate 94*b* may be fitted in the locking groove 94*a*' of the pressing block 94*a*, so when the fastening arm 94*b*' reaches the inner end of the locking groove 94*a*' while the pressing block 94*a* is moved down, the pressing block 94*a* may no longer be moved down.

The coupling unit 93 may be coupled to the cover plate 91 with the pressing unit 94 therebetween, so the pressing unit 94 may be maintained between the coupling space 93*a* and the operation hole 91*b*" of the second plate 91*b* without separating.

As for the handle 95, the handle 95 may have an arc-shaped holding body 95*a* that a user may hold and a rotary shaft 95*b* connected to an end of the holding body 95*a*. The rotary shaft 95*b* may be rotatably coupled to the cover plate 91. As shown in FIG. 12, when the handle 95 is erected, the pressing unit 94 may presses the inlet Ba of the drink container B, but when the handle 95 is laid to be positioned in the same plane as the cover plate 91, the pressing unit 94 may release the inlet Ba of the drink container B.

As shown in FIGS. 7 and 8, the protrusion cam portions 95*b*' may be formed on the rotary shaft 95*b*. The protrusion cam portions 95*b*' may variably protrude downward, that is, toward the pressing unit 94 when the handle 95 is rotated. Clearly, when the handle 95 is rotated to be erected (counterclockwise in FIG. 7), the protrusion cam portions 95*b*' may further protrude toward the pressing block 94*a* of the pressing unit 94, thereby pressing down the pressing block 94*a*. The protrusion cam portions 95*b*' may have various shapes, but in the embodiment, the protrusion cam portions 95*b*' may have a shape protruding from the rotary shaft having a circular cross-section and having substantially perpendicular edges.

The cover assembly 90 may include an injection pipe 99*b* and a discharge pipe 99*a*. The injection pipe 99*b* may be connected to a supply pipe 100 to be described below when the cover assembly 90 is seated on the upper cover 20 of the cabinet 10 while fixing the inlet Ba of the drink container B. The discharge pipe 99*a* may be connected to the dispenser nozzle 70 to discharge the drink in the drink container to the dispenser nozzle 70.

Referring to FIG. 8, the injection pipe 99*b* and the discharge pipe 99*a* may extend in parallel with each other substantially in an L-shape. The discharge pipe 99*a* may extend downward further than the injection pipe 99*b*. The discharge pipe 99*a* may be supposed to discharge a drink, so it should extend up to or close to the bottom of the drink container B. The injection pipe 99*b* and the discharge pipe 99*a* may be made of a flexible material such as flexible silicon, but may be made of metal or synthetic resin.

Referring to FIGS. 6 and 8, an end portion 99*b*' of the injection pipe 99*b* and an end portion 99*a*' of the discharge pipe 99*a* may extend perpendicular to the longitudinal direction of the drink container B, and the ends of the end portions may extend in the longitudinal direction of the drink container B to be exposed downward. The exposed ends of the injection pipe 99*b* and the discharge pipe 99*a* are shown in FIG. 6. The exposed end portion 99*b*' of the injection pipe 99*b* and the exposed end 99*a*' of the discharge pipe 99*a* may be respectively connected to connection pipes 212 and 213 of a connection assembly 200 to be described below.

Since the injection pipe 99*b* and the discharge pipe 99*a* may be fixed to the cover assembly 10 in the embodiment, the pipes may be naturally separated when the cover assembly 10 is separated from the cabinet 10. Accordingly, when the cover assembly 90 functioning as both of a handle and a cover is separated from the refrigerator, the injection pipe 99*b* and the discharge pipe 99*a* may also be separated, and a user may easily wash the injection pipe 99*b* and the discharge pipe 99*a*. In particular, the discharge pipe 99*a*, which may take up a drink from the drink container B up to the dispenser nozzle 70, may occupy most of a drink discharge path, so it may be possible to wash most of the discharge path by washing the discharge pipe 99*a* of the cover assembly 90.

Figure 9:
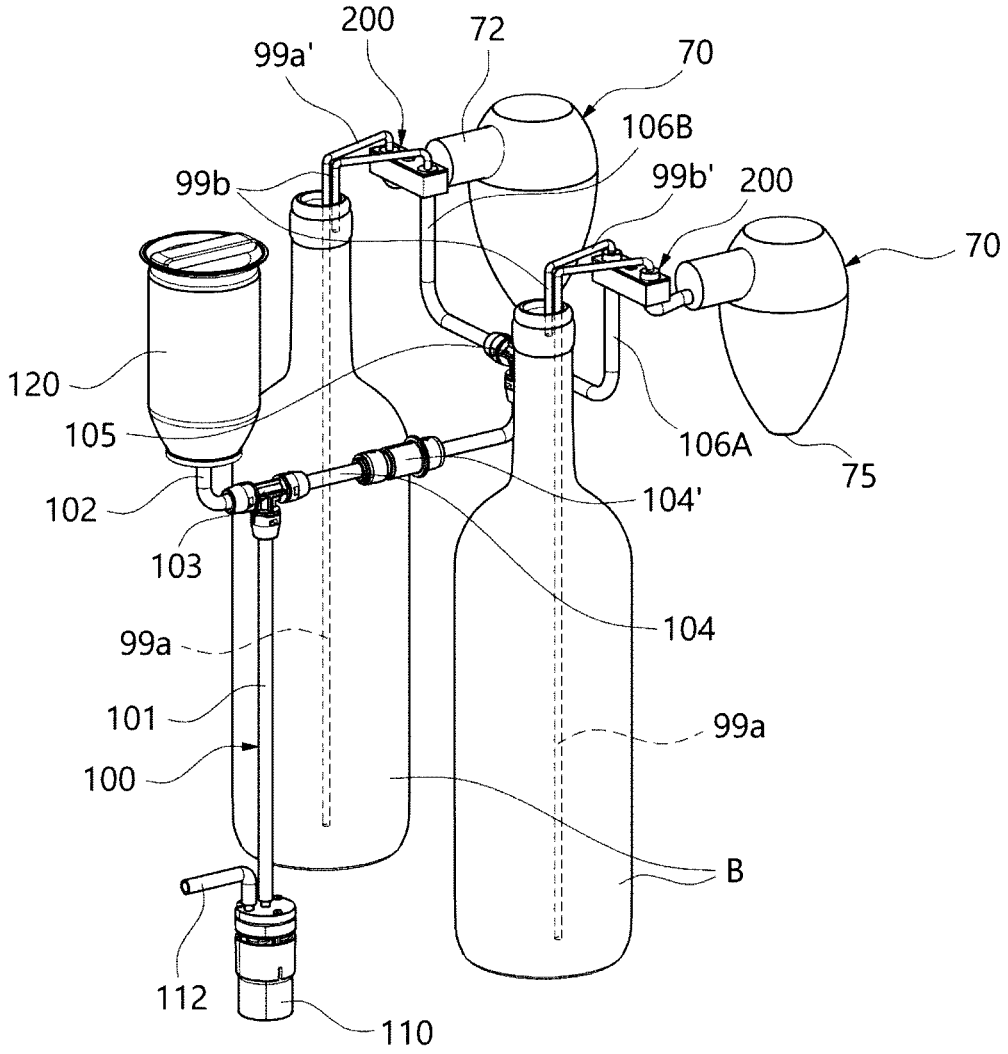
FIG. 9 is a perspective view showing the structures of a supply pipe, an air pump, and a gas tank of an embodiment of the present disclosure.

FIG. 9 shows the structure of the supply pipe 100. For reference, the supply pipe 100 may be provided to supply high-pressure air or unreactive gas into the injection pipe 99*b* and may be disposed in the installation space of the cabinet 10. The cabinet 10, the inner casing 30, etc. are not shown in FIG. 9 to help understanding.

The supply pipe 100 may be disposed across the installation space of the cabinet 10 and may be composed of several tubes. More clearly, the supply pipe 100 may include a pump connection line 101 connected to an air pump 110 and a tank connection line 102 connected to a gas tank 120. The pump connection line 101 and the tank connection line 102 may be disposed close to the rear plate 13 in the installation space of the cabinet 10.

The pump connection line 101 and the tank connection line 102 may be connected to a first valve 103 that may be a 3-way valve and a main supply line 104 may be connected to the first valve 103. Accordingly, any one of the pump connection line 101 and the tank connection line 102 may be connected to the main supply line 104 by operating the first valve 103. For example, when the first valve 103 is operated and (i) the pump connection line 1010 and the main supply line 104 are connected to each other, air increased in pressure in the air pump 110 may be sent to the main supply line 104; and (ii) when the tank connection line 102 and the main supply line 104 are connected to each other, an unreactive gas may be sent to the main supply line 104 from the gas tank 120.

The main supply line 104 may be divided into diverging lines 106A and 106B. The diverging lines 106A and 106B may be formed to divide the main supply line in several branches. The number of the diverging lines 106A and 106B may be the same as the number of the storage compartments 32, that is, the number of drink containers B accommodated in the storage compartment 32. Two diverging lines 106A and 106B may be provided in the embodiment.

A second valve 105 may be disposed between the main supply line 104 and the diverging lines 106A and 106B. The second valve 105 may be a 3-phase valve and may selectively connect the main supply line 104 to any one of the two diverging lines 106A and 106B.

The diverging lines 106A and 106B may be connected to the connection assembly 200 to be described below and connected to the injection pipe 99*b* and the discharge pipe 99*a* described above, whereby the injection pipe 99*b* and the diverging lines 106A and 106B may be connected to each other and the discharge pipe 99*a* and the dispenser nozzles 70 may be connected to each other through the connection assembly 200. Obviously, when one storage compartment 32 is provided and only one drink container B is stored, the diverging lines 106A and 106B may not be provided and the main supply line 104 may be directly connected to the connection assembly 200.

A control valve 104' may be further disposed in the main supply line 104. The control valve 104' may be provided to prevent air from flowing inside from an air supply pipe 112 connected to the air pump 110 and from being sent to the injection pipe 99*b* when the first valve 103 opens the side going to the air pump 110, and may be disposed at the middle of the main supply line 104.

Meanwhile, the air pump 110 and the gas tank 120 may be disposed in the cabinet 10. The air pump 110 may be provided to supply high-pressure air to the main supply line 104 and may be operated when it is powered. When the air pump 110 injects high-pressure air into the drink container B through the main supply line 104, the internal pressure of the drink container B may be increased and the drink may be discharged through the discharge pipe 99*a*. Accordingly, the drink may be supplied to a user through the dispenser nozzle 70.

The air pump 110 may be disposed close to the bottom of the cabinet 10 behind the storage compartment 32. When the air pump 110 is disposed at the rear portion, the degree of noise that may be generated and transmitted forward while the air pump 110 is operated may be reduced.

The air supply pipe 112 may be connected to the air pump 110 and may have one open side, so it may be supplied with air from the outside. Although it was exemplified that the air pump 110 may be operated by power, the air pump 110 may be a tank structure filled with gas compressed under high pressure.

The gas tank 120 may be filled with an unreactive gas and may selectively supply the unreactive gas to the drink container B through the main supply line 104. When the unreactive gas is injected into the drink container B through the injection pipe 99*b*, it may be possible to a drink from being oxidized by oxygen existing in the drink container B. The unreactive gas may be unreactive gas such as nitrogen, helium gas, argon gas, carbon dioxide, or may be a gas mixture of one or more of the gases.

In the embodiment, the purpose of the gas tank 120 may be only to prevent oxidation of a drink and the air pump 110 described above may be in charge of discharging a drink. Accordingly, the unreactive gas in the gas tank 120 may have only to be intermittently injected into the drink container B, the consumption rate of the gas tank 120 decreases.

The gas tank 120 may be received in an erect state in the cabinet 10 through a tank mount hole 23 formed at the upper cover 20 of the cabinet 10. The tank mount hole 23 may be formed through the upper cover 20, similar to the open hole 22, and may be positioned closer to the rear plate 13 than the open hole 22.

Since the gas tank 120 may be installed through the tank mount hole 23, the tank mount hole 23 may be selectively closed by the door 24. That is, although a portion of the gas tank 120 is exposed in FIG. 1, the gas tank 120 may not be exposed to the outside when the door 24 is closed. On the contrary, when only the door 24 is opened, a user may easily separate and replace the gas tank 120. In particular, since the gas tank 120 may be disposed on the top of the cabinet 10, the gas tank 120 may be easily replaced.

Although the gas tank 120 and the air pump 110 may be installed in the cabinet 10 in the embodiment, alternatively, the gas tank 120 and the air pump 110 may be provided as separate parts outside the cabinet 10. In this case, the supply pipe 100 may further extend outward from the cabinet 10 and may be connected to the gas tank 120 and the air pump 110.

Figure 10:
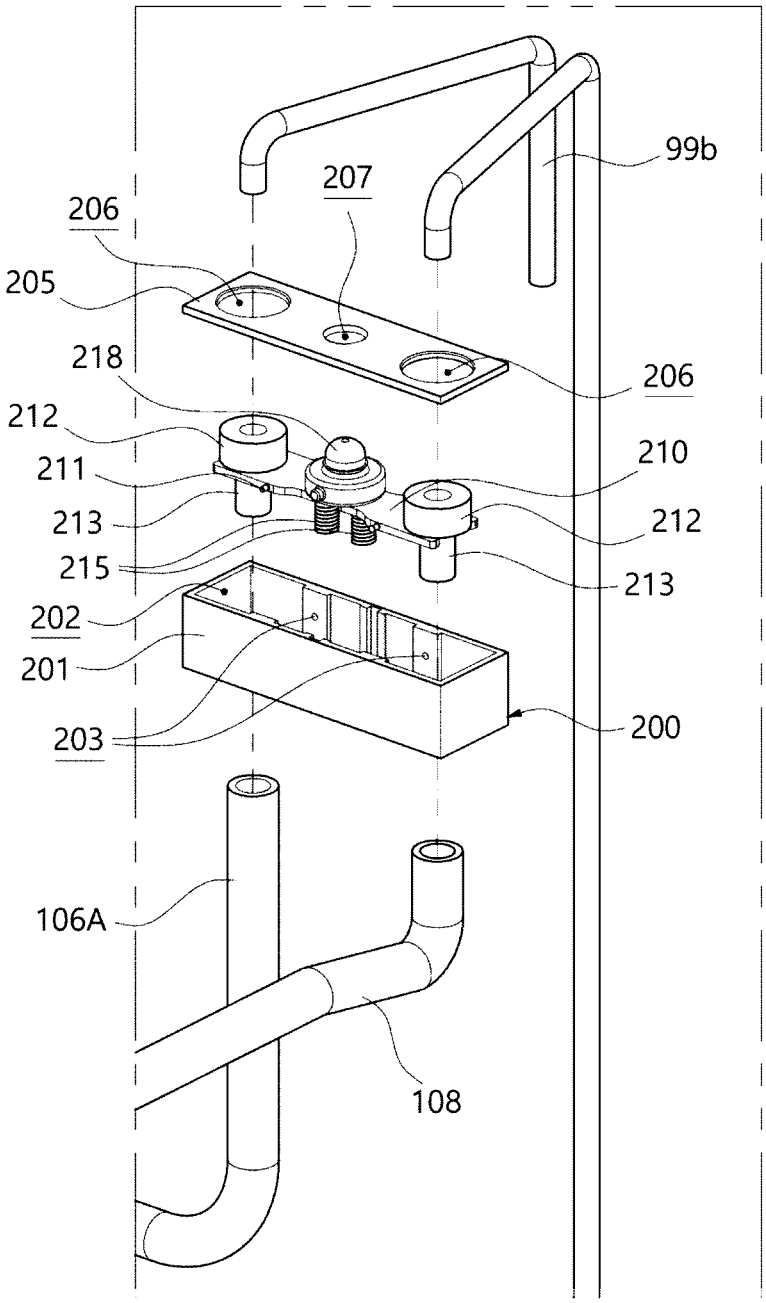
FIG. 10 is an exploded perspective view showing the configuration of a connection assembly of an embodiment of the present disclosure.

FIG. 10 shows the connection assembly 200. The connection assembly 200 may be disposed in the cabinet 10. When the cover assembly 90 fixing the drink container B is seated on the upper cover 20 of the cabinet 10, the connection assembly 200 may be operated with seating of the cover assembly 90. When the connection assembly 200 is operated, the connection assembly 200 may connect at least one or more of (i) the supply pipe 100 and the injection pipe 99*b* of the drink container B, and (ii) the discharge pipe 99*a* of the discharge pipe 99*a* of the drink container B and the dispenser nozzle 70.

That is, the injection pipe 99*b* and the discharge pipe 99*a* may be disposed in the cover assembly 90 in the embodiment, so the pipes may be separated together with the cover assembly 90 from the cabinet 10. Further, the connection assembly 200 may connect the injection pipe 99*b* and the discharge pipe 99 to the diverging pipes 106A and 106B and the dispenser nozzle 70, respectively. Accordingly, a user may not need to connect the injection pipe 99*b* and the discharge pipe 99 to other tubes in person.

As for the structure of the connection assembly 200, the frame of the connection assembly 200 may form a connection housing 201, and an operation protrusion 218, an operation plate 210, an elastic member 215, connection pipes 212 and 213, etc. may be disposed in an internal space 202 of the connection housing 201. The operation protrusion 218 may be a part that may be disposed in the connection housing 201 and pressed and moved by the cover assembly 90, and may be movably disposed in the connection housing 201.

Referring to FIG. 15A, the operation protrusion 218 may protrude from a seat 22' of the upper cover 20, and when the cover assembly 90 is seated in the seat 22', the protrusion 218 may be pressed by the cover assembly 90, thereby being retracted into the connection housing 201. This state is shown in FIG. 15B.

Sliding grooves 203 may be formed in the internal space 202 of the connection housing 201 and sliding protrusions 211 of the operation plate 210 may be fitted in the sliding grooves 203, so the operation plate 210 may move on the sliding protrusions 211. The operation plate 210 may have a flat plate shape and may rotate when the operation protrusion 218 is moved.

The operation plate 210 may be connected to the operation protrusion 218 at one side and may be connected to the connection pipes 212 and 213 at the other side. Accordingly, when one side of the operation plate 210 is moved down by the operation protrusion 218, the other side of the operation plate 210 may move up and lift up the connection pipes 212 and 213. When the connection pipes 212 and 213 are lifted up, the connection pipes 212 and 213 may be connected to the injection pipe 99*b* and the discharge pipe 99*a* disposed over the connection pipes while surrounding the injection pipe and the discharge pipe.

As for the connection pipes 212 and 213, connection bodies 212 may be disposed over the connection pipes 212 and 213, so the connection pipes 212 and 213 may be connected to the ends of the injection pipe 99*b* and the discharge pipe 99*a*. Further, extension pipes 213 may be connected to the lower portions of the connection pipes 212 and 213 and may be connected to the diverging liens 106A and 106B and a discharge line 108 fixed thereunder. The extension pipe 213 may extend a predetermined distance, so even if the connection pipes 212 and 213 are lifted, extension pipe 213 may keep connected to the diverging lines 106A and 106B and the discharge line 108. The discharge line 208 may be a pipe extending from the dispenser nozzle 70.

The operation plate 210 may be provide in a symmetric pair, which may move a pair of connection pipes 212 and 213, respectively, thereby connecting the diverging lines 106A and 106B and the injection pipe 99*b* and connecting the discharge line 108 and the discharge pipe 99*a*. The operation protrusion 218 may be positioned at the middle of the pair of operation plates 210, thereby being able to simultaneously operate the pair of operation plate 210.

Holes 206 and 207 may be formed at the housing cover 205 of the connection housing 201. The connection bodies 212 of the connection pipes 212 and 213 may be moved up and down through some holes 206 of the holes and the operation protrusion 218 may be moved up and down through the other hole 207.

The elastic members 215 may be disposed in the connection housing 201. The elastic members 215 may elastically support the operation protrusion 218 in a standby state in which the operation protrusion 218 may be pressed by the cover assembly 90. That is, the elastic members 215 may maintain the operation protrusion 218 in the standby state and FIG. 15A shows the standby state of the operation protrusion 218. When the cover assembly 90 is separated from the seat 22', the operation protrusion 218 may be pushed up by the elastic members 215. The elastic members 215 may be springs the embodiment, but may be made of an elastic material such as silicon rather than the springs. Alternatively, the elastic members 215 may not be provided and the operation plate 210 may be formed in a symmetric structure, whereby the operation protrusion 218 may protrude by gravity.

Next, a process in which the cover assembly 90 fixes a drink container B is described. Referring to FIG. 11, the handle 95 of the cover assembly 90 is laid, in which the protrusive cam portions 95' of the rotary shaft 95*b* may not press yet the pressing block 94*a* of the pressing unit 94. Accordingly, the pressing block 94*a* may also not elastically deform the compression block 94*c*, so the inlet Ba of the drink container B may be relatively easily fitted into the compression hole 94*c*' formed in the compression block 94*c*.

In this state, when the handle 95 is rotated in the direction of the arrow ①, the protrusive cam portions 95*b*' may be rotated in the same direction, that is, in the direction of the arrow ②. Accordingly, the protrusive cam portions 95*b*' may press the pressing block 94*a* of the pressing unit 94 downward, that is, in the direction of the arrow ③ in FIG. 12. As the pressing block 94*a* is moved down, the compression block 94*c* stacked in close contact under the pressing block 93*a* may be pressed and elastically deformed.

Since the outer side of the compression block 94*c* may be blocked by the coupling unit 93, the compression block 94 may be necessarily deformed inward (in the direction of the arrow ④). Accordingly, the diameter of the compression hole 94*c*' at the center of the compression block 94*c* may decrease, thereby strongly compress the inlet Ba of the drink container B. As a result, the compression block 94C may strongly press and fix the inlet Ba of the drink container B.

Accordingly, when a user lifts up the cover assembly 90, the drink container B may also be lifted. The user may hold the handle 95 of the cover assembly 90 and put the drink container into the storage compartment 32 through the open hole 22 of the refrigerator.

When the drink container B is received in the storage compartment 32, the drink container B may be naturally connected to the air pump 110 and the gas tank 120. FIGS. 15A to 16B show the operation state of the connection assembly 200 for connecting the supply pipe 100 to the drink container B.

Figure 16A:
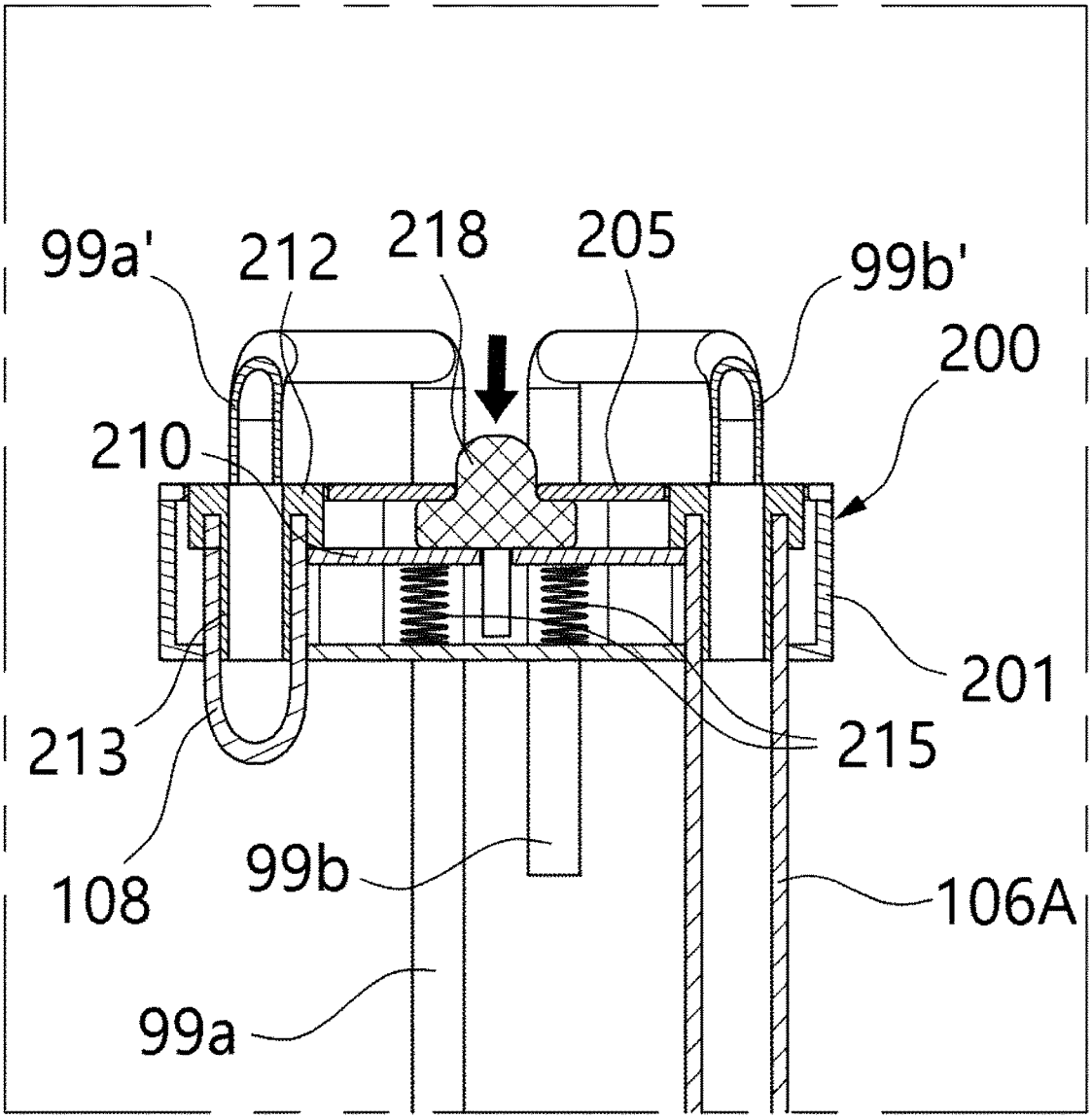
FIGS. 16A and 16B are operational state views showing that the connection assembly of an embodiment of the present disclosure operates to connect a pipe.

FIGS. 15A and 16A show the state before the connection assembly 200 is not operated, that is, the standby state. In this state, the operation protrusion 218 may protrude upward, so it may be ready to be pressed and retracted by the cover assembly 90.

Figure 16B:
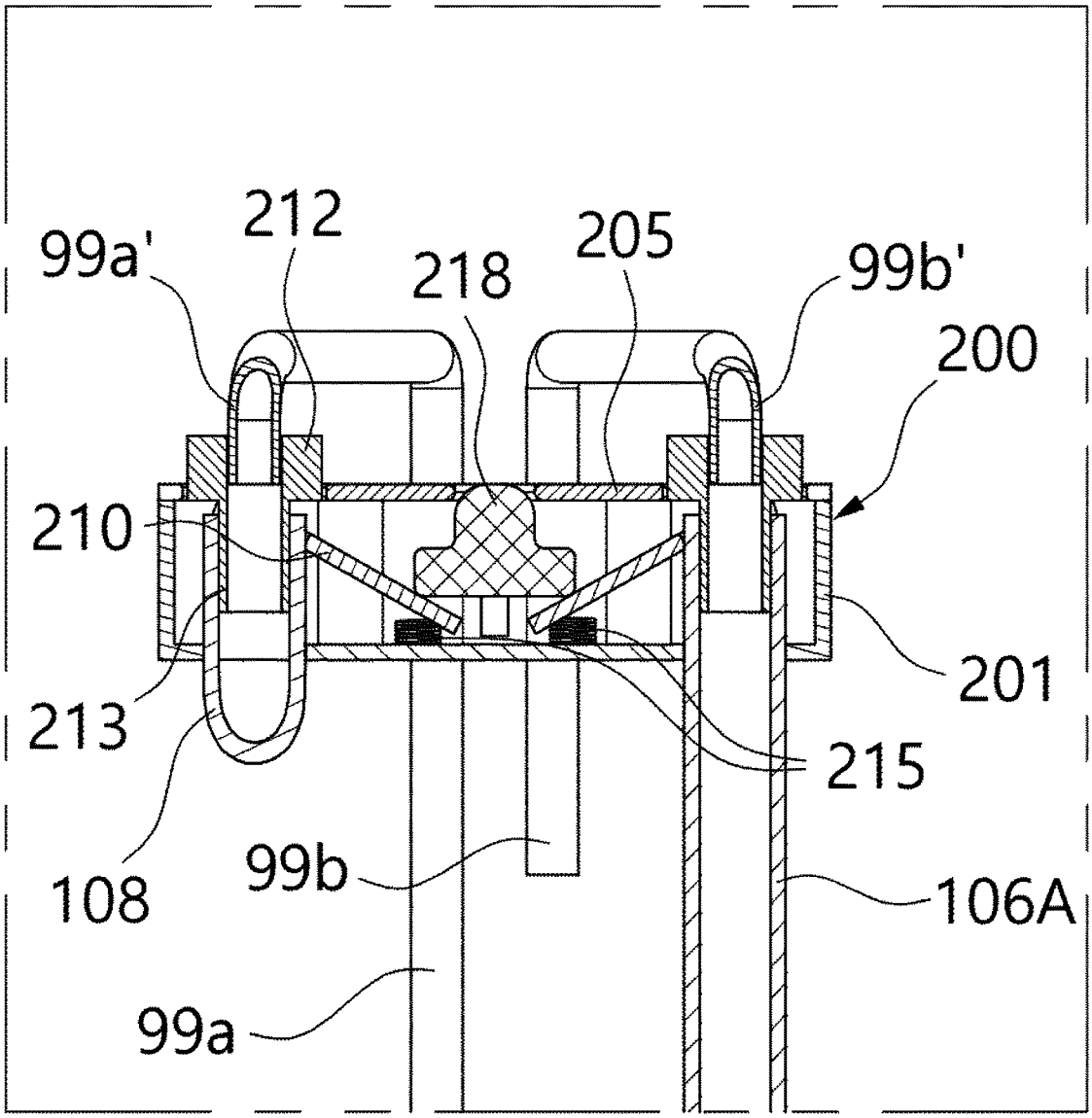

As described above, the operation protrusion 218 may protrude from the seat 22' of the upper cover 20, and when the cover assembly 90 is seated in the seat 22', the protrusion 218 may be pressed by the cover assembly 90, thereby being retracted into the connection housing 201. This state is shown in FIG. 16B.

As the operation protrusion 218 is retracted downward, a side of the operation plate 210 may be pressed and the operation plate 210 may be rotated. Accordingly, the opposite side of the operation plate 210 may be moved up, thereby pulling up the connection pipes 212 and 213. When the connection pipes 212 and 213 are lifted up, the connection pipes 212 and 213 may be connected to the injection pipe 99*b* and the discharge pipe 99*a* disposed over the connection pipes while surrounding the injection pipe and the discharge pipe. This state is clearly shown in FIG. 16B. Accordingly, only by seating the cover assembly 90 into the cabinet 10, the injection pipe 99*b* and the discharge pipe 99*a* of the drink container B may be connected to the diverging lines 106A and 106B and the discharge line 108, respectively, through the connection assembly 200.

Figure 13:
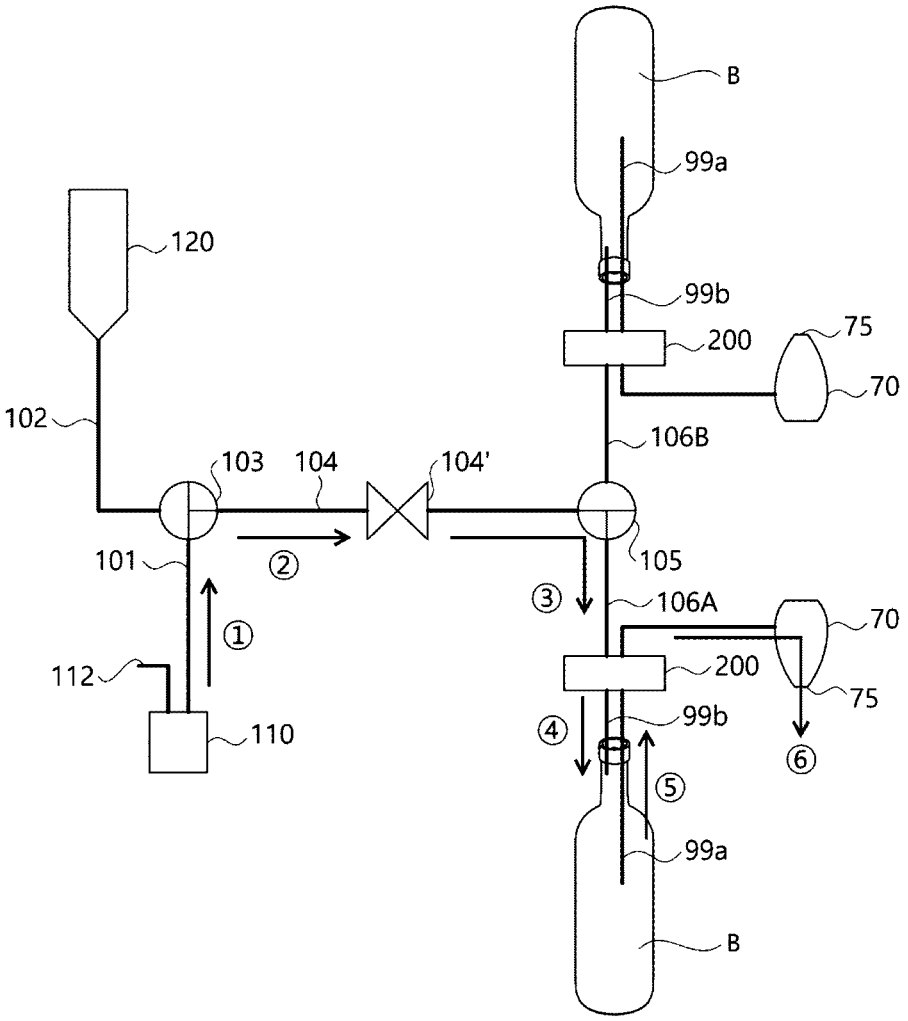
FIG. 13 is a structural view showing a process of increasing the pressure of a drink container using an air pump of an embodiment of the present disclosure.
Figure 14:
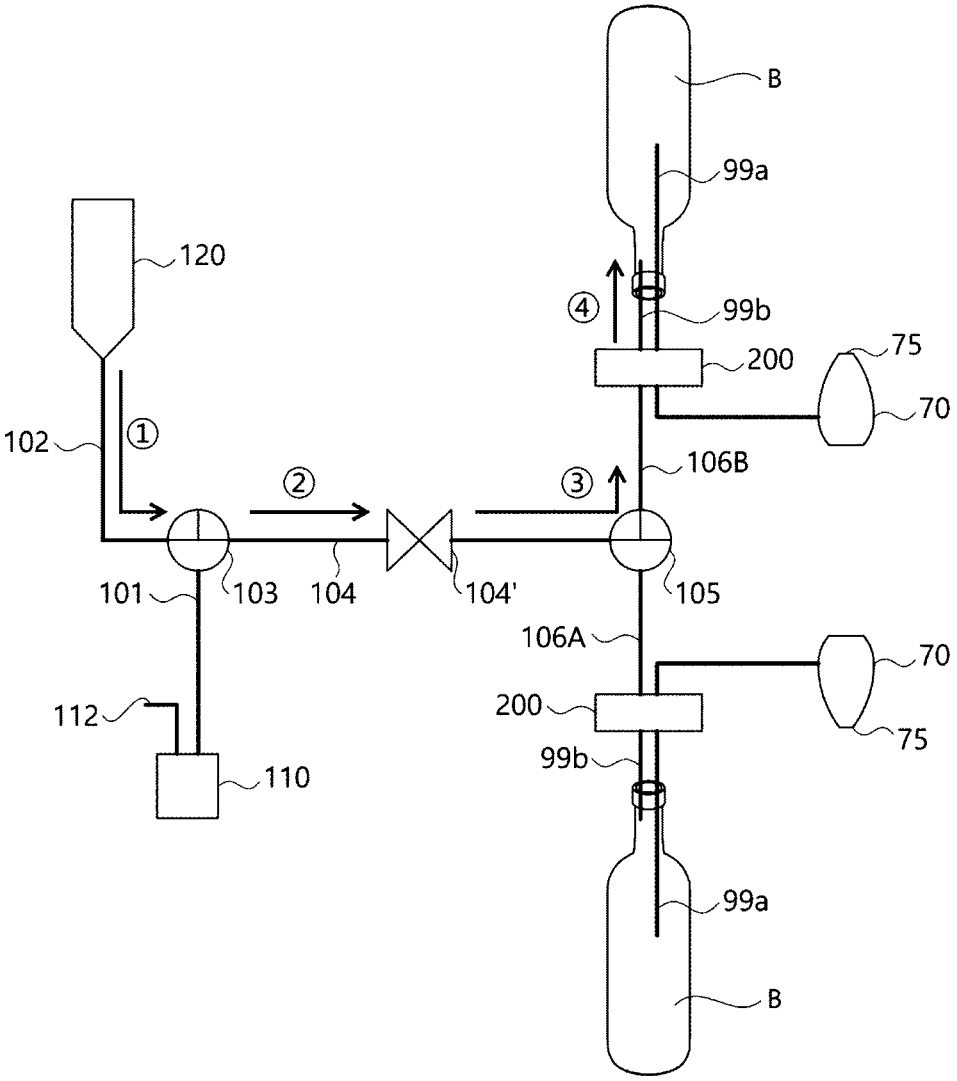
FIG. 14 is a structural view showing a process of injecting an unreactive gas into a drink container using a gas tank of an embodiment of the present disclosure.

Accordingly, a state in which high-pressure air may be injected or an unreactive gas may be supplied into the drink container B may be obtained. FIG. 13 shows the sequence of injecting high-pressure air into the drink container B and FIG. 14 shows a sequence of supplying an unreactive gas into the drink container B.

First, referring to FIG. 13, the first valve 103 may be operated, whereby the pump connection line 101 and the main supply line 104 may be connected to each other. The tank connection line 102 may not be connected to the main supply line 104 because it is blocked by the first valve 103. Accordingly, as the air pump 110 is operated, the air suctioned through the air supply pipe 112 may be sent through the pump connection line 101 by high pressure (in the direction of the arrow ①) and then may pass sequentially through the first valve 103 and the main supply line 104 (in the direction of the arrow ②). In this process, since the control valve 104' may be open, the high-pressure air may keep passing through the main supply line 104.

Meanwhile, the second valve 105 may connect the main supply line 104 to the first diverging line 106A of the two diverging lines 106A and 106B. Accordingly, the high-pressure air may be guided to the connection assembly 200 (in the direction of the arrow through the first diverging line 106A. The high-pressure air that has passed through the connection assembly 200 may be injected into the drink container B (in the direction of the arrow ④) through the injection pipe 99*b* of the cover assembly 90.

The internal pressure of the drink container B in which the high-pressure air is injected may be increased, and the stored drink may be discharged through the discharge pipe 99*a*. More clearly, the drink in the drink container B may rise along the discharge pipe 99*a* (in the direction of the arrow ⑤) and then may be delivered to the dispenser nozzle 70 through the connection assembly 200. Finally, the drink may be supplied downward (in the direction of the arrow ⑥) through the drink outlet 75 and a user may receive the drink using a cup, etc.

Meanwhile, when the high-pressure air is injected into the drink container B, as described above, oxygen mixed in the air may exit in the drink container and may oxidize the drink, whereby the flavor may be changed or the drink may be spoiled. In order to prevent this problem, an unreactive gas may be injected into the drink container B.

Referring to FIG. 14 showing a process of injecting an unreactive gas into the drink container B, first, the first valve 103 may be operated, whereby the tank connection line 102 and the main supply line 104 may be connected to each other. The pump connection line 101 may not be connected to the main supply line 104 because it is blocked by the first valve 103.

Accordingly, the unreactive gas may be discharged from the gas tank 120 and the discharge unreactive gas may pass through the tank connection line 101 (in the direction of the arrow ①) and then may pass sequentially through the first valve 103 and the main supply line 104 (in the direction of the arrow ②). In this process, since the control valve 104' may be open, the unreactive gas may keep passing through the main supply line 104.

Meanwhile, the second valve 105 may connect the main supply line 104 to the second diverging line 106B of the two diverging lines 106B and 106B. Accordingly, the high-pressure air may be guided to the connection assembly 200 (in the direction of the arrow ③) through the second diverging line 106B. This is only one example and the second valve 105 may sent the unreactive gas to another drink container B (disposed at a lower portion in FIG. 14) through the first diverging line 106A.

The unreactive gas that has passed through the connection assembly 200 may be injected into the drink container B (in the direction of the arrow ④) through the injection pipe 99*b* of the cover assembly 90. The inside of the drink container B in which the unreactive gas is injected may be prevented from oxidizing by the properties of the unreactive gas. Such operation for preventing oxidation may be periodically performed with predetermined intervals by automatic control. Alternatively, a sensor (not shown) may be disposed in the storage compartment 32 to measure the concentration of oxygen, and accordingly, it may be possible to supply an unreactive gas by controlling the first valve 103 and the second valve 105.

Further, as described above, even if several drink containers B are simultaneously received, it may be possible to prevent oxidation of a drink by appropriately controlling the valves and a user may separately receive drinks from the drink containers B.

Even through all components of embodiments of the present disclosure are combined in one unit or operated in combination in the above description, the present disclosure is not limited thereto. That is, one or more of all the components may be selectively combined and operated as long as it is in the objective range of the present disclosure. Further, the terms "comprise", "include", "have", etc. when used in this specification mean that the components can exist inside unless specifically stated otherwise, so they should be construed as being able to further include other components. Unless otherwise defined, all terms including technical and scientific terms used herein have the same meaning as commonly understood by those skilled in the art to which the present disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The above description merely explains the spirit of the present disclosure and the present disclosure may be changed and modified in various ways without departing from the spirit of the present disclosure by those skilled in the art. Accordingly, the embodiments described herein are provided merely not to limit, but to explain the spirit of the present disclosure, and the spirit of the present disclosure is not limited by the embodiments. The patent right of the present disclosure should be construed by the following claims and the scope and spirit of the disclosure should be construed as being included in the patent right of the present disclosure.

What is claimed is:

1. A refrigerator, comprising:

a cabinet having at least one storage compartment therein, the storage compartment being configured to store a drink container therein;

at least one dispenser nozzle at least partially exposed outside the cabinet, the dispenser nozzle being connectable to the drink container to supply a drink in the drink container to outside the cabinet;

a pump connection line configured to supply air into the drink container to increase pressure in the drink container; and a tank connection line configured to supply an unreactive gas into the drink container to prevent oxidation of the drink in the drink container, wherein a supply pipe is disposed in the cabinet, the supply pipe including the pump connection line and the tank connection line, the supply pipe being configured to selectively connect the pump connection line and the tank connection line to an interior of the drink container.

2. The refrigerator of claim 1, further comprising:

an air pump connected to the pump connection line to provide pressurized air into the pump connection line; and a gas tank connected to the tank connection line to provide the unreactive gas to the tank connection line.

3. The refrigerator of claim 2, wherein the cabinet includes an upper cover having a tank mount hole through which the gas tank is insertable into the cabinet.

4. The refrigerator of claim 3, wherein the upper cover includes an opening through which the drink container is insertable into the storage compartment, and wherein the refrigerator further comprises a door at the cabinet to selectively cover and uncover the opening and the tank mount hole.

5. The refrigerator of claim 2, wherein the refrigerator further comprises a cover assembly, the cover assembly being selectively couplable to an opening of the drink container, the cover assembly including:

an injection pipe selectively connected to the air pump and the gas tank; and a discharge pipe connected to the dispenser nozzle.

6. The refrigerator of claim 5, wherein the cabinet includes an upper cover having an opening, and wherein the cover assembly includes:

a cover plate configured to block the opening of the upper cover when being fixed to an edge of the opening of the upper cover, the cover plate having the injection pipe and the discharge pipe extending therethrough;

a coupler protruding from the cover plate, the coupler being configured to extend into the opening of the upper cover and to surround the opening of the drink container; and a handle rotatably coupled to the cover plate, the handle protruding in an opposite direction to the coupler, the handle including a protrusive cam portion that variably protrudes toward the coupler of the cover assembly when the handle is rotated with respect to the cover assembly, and wherein the coupler is at least partially movably disposed in the cover assembly to compress a circumference of the opening of the drink container when the coupler is moved by the protrusive cam portion.

7. The refrigerator of claim 1, wherein the pump connection line has a first end connectable to an air pump and a second end, wherein the tank connection line has a first end connectable to a gas tank and a second end, wherein the supply pipe further includes:

a first valve connected to the second end of the pump connection line and the second end of the tank connection line; and a main supply line coupled to the first valve and selectively connected to any one of the pump connection line and the tank connection line by the first valve, and wherein at least one injection pipe is connected to the main supply line to inject air from the air pump or an unreactive gas from the gas tank into the drink container.

8. The refrigerator of claim 7, wherein the at least one storage compartment includes two storage compartments, wherein the at least one dispenser nozzle includes two dispenser nozzles, and wherein the at least one injection pipe includes two injection pipes, each injection pipe being connectable to a corresponding drink container received in the storage compartments, the two injection pipes being connected to the main supply line through a second valve.

9. The refrigerator of claim 1, wherein the cabinet includes an upper cover, wherein the storage compartment includes an inlet, and wherein the refrigerator further comprises a cover assembly configured to cover the inlet of the storage compartment when the cover assembly is fixed to the upper cover, the cover assembly being selectively couplable to an opening of the drink container.

10. The refrigerator of claim 1, wherein the cabinet includes an upper cover, wherein the refrigerator further comprises a cover assembly, the cover assembly being selectively couplable to an opening of the drink container, the cover assembly including an injection pipe, and wherein, when the cover assembly is seated on the upper cover of the cabinet while being coupled to the opening of the drink container, the injection pipe is connected to the supply pipe.

11. The refrigerator of claim 10, wherein the cover assembly includes a discharge pipe connected to the dispenser nozzle to discharge the drink in the drink container to the dispenser nozzle when the cover assembly is seated on the upper cover of the cabinet while being coupled to the opening of the drink container.

12. The refrigerator of claim 11, wherein the injection pipe and the discharge pipe extend in parallel with each other, and wherein the discharge pipe is longer than the injection pipe such that the discharge pipe extends further into the drink container.

13. The refrigerator of claim 1, wherein the cabinet includes an upper cover, and wherein the refrigerator further comprises:

a cover assembly including an injection pipe and a discharge pipe; and a connection assembly in the cabinet, the connection assembly being configured to connect at least one of the supply pipe to the injection pipe or the discharge pipe to the dispenser nozzle when the cover assembly is coupled to the drink container while being seated on the upper cover.

14. The refrigerator of claim 13, wherein the connection assembly includes:

a connection housing;

an operation protrusion disposed in the connection housing, the operation protrusion being pressable by the cover assembly to move the operation protrusion; and a pair of connection pipes disposed in the connection housing, the pair of connection pipes being movable with movement of the operation protrusion, and wherein, when the connection pipes are moved upward, the connection pipes connect the supply pipe to the injection pipe and the discharge pipe to the dispenser nozzle.

15. The refrigerator of claim 14, wherein a pair of symmetric operation plates is disposed in the connection housing and the operation protrusion is connected to a side of each of the operation plates such that, when the operation protrusion is pressed by the cover assembly, the operation plates are rotated to move the connection pipes.

16. The refrigerator of claim 14, wherein the connection assembly further includes an elastic member elastically supporting the operation protrusion in a standby state in which the operation protrusion is pressable by the cover assembly.

17. The refrigerator of claim 14, wherein the upper cover includes a seat to support the cover assembly, and wherein the operation protrusion at least partially protrudes from the seat of the upper cover, and, when the cover assembly is seated in the seat, the operation protrusion is pressed by the cover assembly.

18. The refrigerator of claim 1, wherein the refrigerator further comprises:

a cooler located behind the storage compartment in the cabinet; and an air pump located adjacent to a bottom of the cabinet and located behind the storage compartment.

19. A refrigerator, comprising:

a cabinet having an upper cover and at least one storage compartment therein, the storage compartment being configured to store a drink container therein, the storage compartment having an inlet;

at least one dispenser nozzle at least partially exposed outside the cabinet, the dispenser nozzle being connectable to the drink container to supply a drink in the drink container to outside the cabinet;

an air pump in the cabinet, the air pump configured to supply air into the drink container to increase pressure in the drink container;

a gas tank in the cabinet, the gas tank configured to supply an unreactive gas into the drink container to prevent oxidation of the drink in the drink container;

a supply pipe in the cabinet, the supply pipe being connected to the air pump and the gas tank; and a cover assembly selectively coupled to an opening of the drink container, the cover assembly covering the inlet of the storage compartment when seated on the upper cover, the cover assembly being configured to connect at least one of the air pump or the gas tank to an inside of the drink container when seated on the upper cover of the cabinet.

* * * * *